US011220860B2

(12) United States Patent
Chen et al.

(10) Patent No.: US 11,220,860 B2
(45) Date of Patent: Jan. 11, 2022

(54) POSITION-FIXING SYSTEM

(71) Applicant: Nien Made Enterprise Co., Ltd., Taichung (TW)

(72) Inventors: Lin Chen, Taichung (TW); Keng-Hao Nien, Taichung (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 580 days.

(21) Appl. No.: 16/102,742

(22) Filed: Aug. 14, 2018

(65) Prior Publication Data

US 2019/0063151 A1 Feb. 28, 2019

(30) Foreign Application Priority Data

Aug. 22, 2017 (CN) ..... 201721053300.1
Mar. 21, 2018 (CN) ..... 201820385179.0

(51) Int. Cl.

| | |
|---|---|
| ***E06B 9/80*** | (2006.01) |
| ***E06B 9/78*** | (2006.01) |
| ***E06B 9/60*** | (2006.01) |
| ***E06B 9/42*** | (2006.01) |
| ***E06B 9/68*** | (2006.01) |
| ***E06B 9/90*** | (2006.01) |
| *E06B 9/58* | (2006.01) |

(52) U.S. Cl.

CPC ..... *E06B 9/80* (2013.01); *E06B 9/42* (2013.01); *E06B 9/60* (2013.01); *E06B 9/68* (2013.01); *E06B 9/78* (2013.01); *E06B 9/90* (2013.01); *E06B 9/58* (2013.01)

(58) Field of Classification Search

CPC ..... E06B 9/80; E06B 9/60; E06B 9/90; E06B 9/42; E06B 9/56; E06B 9/78; E06B 2009/807; E06B 9/82; E06B 9/84; E06B 2009/905

See application file for complete search history.

(56) References Cited

U.S. PATENT DOCUMENTS

| | | | | |
|---|---|---|---|---|
| 3,965,960 A * | 6/1976 | Massey | A47K 3/38 160/295 |
| 4,429,729 A * | 2/1984 | Winslow | E06B 9/60 144/193.1 |
| 5,078,198 A * | 1/1992 | Tedeschi | E06B 9/60 160/301 |
| 2019/0323285 A1* | 10/2019 | Wong | E06B 9/90 |

* cited by examiner

*Primary Examiner* — Johnnie A. Shablack
*Assistant Examiner* — Jeremy C Ramsey
(74) *Attorney, Agent, or Firm* — Winston Hsu

(57) ABSTRACT

A position-fixing system includes a pole, a guiding member adjacent to the pole, and a movable member fitting around the pole. The pole is immovable relative to a window covering. The guiding member includes a principal axis parallel to an extension axis of the pole, and includes a retaining face substantially extending in the direction of the principal axis, but non-coplanar with it. The movable member corresponds to the retaining face. The movements of the movable member and the guiding member are related to that of a shaft of the window covering. When the window covering is being operated, the movable member is driven to rotate around the pole, and moves along the pole and the guiding member. Due to the retaining face, the movable member keeps contacting the pole to create a friction therebetween. Therefore, the position of a covering material of the window covering can be precisely fixed.

24 Claims, 35 Drawing Sheets

POSITION-FIXING SYSTEM

BACKGROUND OF THE INVENTION

1. Field of the Invention

The present invention relates generally to a position-fixing system, and more particularly to a position-fixing system adapted to fix a position of a covering material of a window covering.

2. Description of the Prior Art

A conventional cordless window covering, e.g., a cordless roller shade, includes a roller and a weighing member. The roller is installed to a bracket and capable of reeling a covering material in and out. The weighing member is connected to a bottom of the covering material so that the covering material is easy to manipulate and to counterbalance. The weighing member can be pulled downward to pull out the covering material correspondingly. As soon as the weighing member is freed from manipulation at any position, the covering material stays at a static limited state because of the effect of a brake mechanism which can counter a rewinding force generated by a spring mechanism. To retract the covering material, the weighing member has to be pulled downward first to disrupt the limited state of the covering material. And then, by letting go of the weighing member, the rewinding force of the spring mechanism takes over, driving the roller to roll up the covering material.

However, conventional brake mechanisms have complex structures and high cost. For example, the laborsaving bead-chain mechanism disclosed in Taiwan Utility Patent No. TWM272484 and the self-locking type sun-shading roller shutter device disclosed in China Utility Patent Application No. CN03229187 both have such disadvantages. Furthermore, after prolonged use, the components involved in a conventional brake mechanism to provide the braking effect are likely to wear out, leading to an inaccurate position-fixing effect. To provide the rewinding force as sufficient as possible, conventional cordless window coverings have to be applied with torsion springs with large torque, which requires higher manufacturing costs. In addition, since the weighing member has to be pulled downward first to disrupt the limited state of the covering material before rolling up the covering material, it would be inconvenient when there is no room for such operation, e.g., when the weighing member is already immediately adjacent to a bottom edge of a window frame as the covering material is fully spread out.

SUMMARY OF THE INVENTION

For above reasons, a position-fixing system which could be widely applied to various types of window coverings is provided. The position-fixing system is easy to operate, and is reliable in-fixing the position of a covering material.

In one aspect of the invention, a position-fixing system is provided, which is applicable to a window covering including a covering material, a shaft, and a bracket. The shaft is pivotally connected to the bracket, and the covering material has an end attached to the shaft so that the covering material is adapted to be spread out from the shaft or rolled up around the shaft. The position-fixing system includes a pole, a guiding member, and a movable member. The pole is mounted to the bracket in an immovable manner and is defined to have an extension axis collinear with a central axis thereof. The guiding member is disposed in the shaft in a manner that the guiding member rotates along with the shaft. The guiding member includes a guiding base spaced from the pole, wherein the guiding base is defined to have a principal axis passing therethrough. The principal axis of the guiding base and the extension axis of the pole extend in a same direction and are parallel to each other; the guiding base has a retaining face provided on a side thereof, and the retaining face and the principal axis are non-coplanar. The movable member fits around the pole and is arranged between the guiding base and the pole. The movable member is adapted to be driven by the rotation of the shaft to rotate relative to the pole. When the covering material is operated to be spread out or rolled up, the movable member and the guiding member are driven by the rotation of the shaft to rotate about the pole, and the movable member travels in a reciprocating manner along the pole and the guiding base; when the movable member is being moved, the movable member remains in contact with the pole as being guided by the retaining face to create a friction.

In one aspect of the invention, a position-fixing system is further provided, which is applicable to a window covering including a covering material, a shaft, and a bracket. The shaft is pivotally connected to the bracket, and the covering material has an end attached to the shaft so that the covering material is adapted to be spread out from the shaft or rolled up around the shaft. The position-fixing system includes a pole, a guiding member, and a movable member. The pole is mounted to the bracket in an immovable manner and is defined to have an extension axis collinear with a central axis thereof. The guiding member is adjacent to the pole and is adapted to be driven by the rotation of the shaft. The movable member fits around the pole and is arranged between the guiding member and the pole. The movable member is adapted to be driven by the rotation of the shaft. When the covering material is operated to be spread out or rolled up, the movable member and the guiding member are actuated by the rotation of the shaft to rotate about the pole, and the movable member travels along the pole and the guiding member in a reciprocating manner. A friction is created between the movable member and the pole when the movable member is being moved, for the movable member is guided by the guiding member to keep in contact with the pole.

With the aforementioned design of the position-fixing system compatible with window coverings, there would be a friction provided between the movable member and the pole, stopping the covering material at the instant position when the operation ends. These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

The present invention will be best understood by referring to the following detailed description of some illustrative embodiments in conjunction with the accompanying drawings, in which.

DETAILED DESCRIPTION

Figure 1:
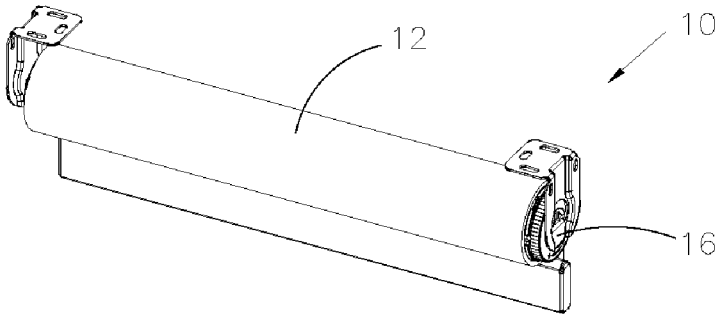
FIG. 1 is a perspective view of a window covering, showing a covering material of the window covering is rolled up.
Figure 2:
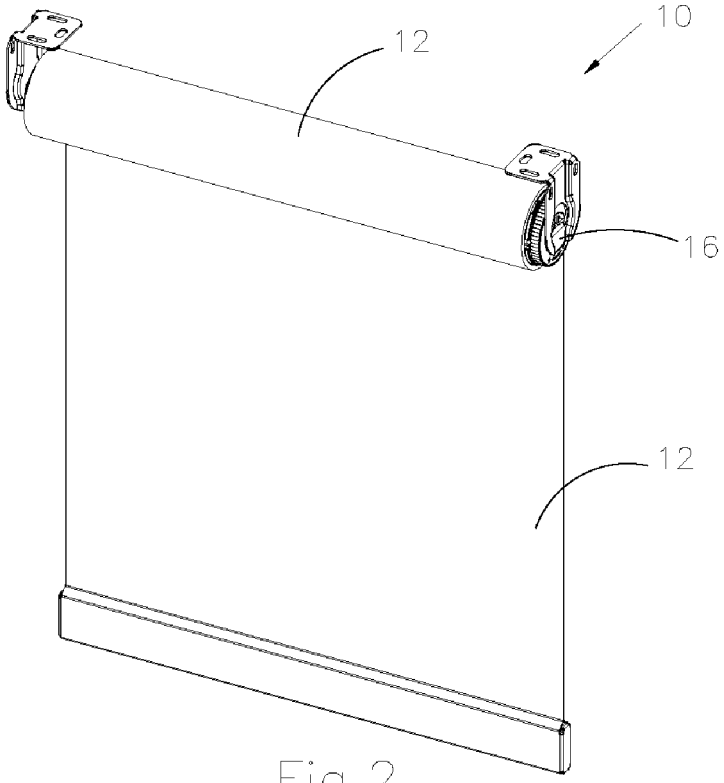
FIG. 2 is a perspective view of the window covering, showing the covering material of the window covering is lowered.

A window covering 10 applied with a position-fixing system of the present invention is illustrated in FIG. 1 and FIG. 2, wherein the window covering 10 shown in FIG. 1 is in a fully retracted state, while the window covering 10 shown in FIG. 2 is in a fully extended state. A position-fixing system 20 of a first embodiment of the present invention applicable to the window covering 10 is illustrated in FIG. 3 to FIG. 10. The window covering 10 includes a covering material 12, a shaft 14, a bracket 16, and a power mechanism 18. The number of the brackets 16 in the current embodiment is two: one on the right side and one on the left side of the window covering 10, each of which is mounted onto a window frame or a wall (not illustrated). The shaft 14 connects the two brackets 16 in a pivotally connected manner via two plugs 162, 164, respectively. The power mechanism 18 includes a drive member 182; a contour of the drive member 182 matches an interior wall of the shaft 14, so that the power mechanism 18 could be moved along with the rotation of the shaft 14. The covering material 12 has an end attached to the shaft 14; when the covering material 12 is pulled down or pushed up, the covering material 12 would be spread out from or reeled up around the shaft 14. A power spring 184 of the power mechanism 18 stores or releases rewinding energy during the process of the extending or retracting the covering material 12. The details about arranging the window covering 10 and the power mechanism 18 thereof will not be further described in the following paragraphs.

The position-fixing system 20 of the first embodiment includes a pole 22, a guiding member 24, and a movable member 26. The position-fixing system 20 is installed in the window covering 10. The pole 22 is mounted to one of the brackets 16 in an immovable manner so as to stay fixed relative to the window covering 10, and the guiding member 24 is adjacent to the pole 22. The pole 22 includes a body 222, a threaded section 224, a first stopper 226, and a second stopper 228. The body 222 is a long rod, and is defined to have an extension axis L collinear to a central axis of the pole 22. The threaded section 224 is formed around the body 222, and the first stopper 226 and the second stopper 228 are respectively adjacent to two ends of the threaded section 224. The guiding member 24 includes a guiding base 242, a first plank 244, and a second plank 246. The guiding base 242 has a retaining face 2422, and is defined to have a principal axis 2424 passing therethrough, wherein the principal axis 2424 extends in the same direction with the extension axis L of the body 222, and is parallel to the extension axis L. A first end 2424*a* and a second end 2424*b* of the principal axis 2424 are at where the first plank 244 and the second plank 246 joint the guiding base 242, respectively. The first plank 244 and the second plank 246 have a first notch 244*a* and a second notch 246*a* respectively. The first and second notches 244*a*, 246*a* fit the body 222 of the pole 22 so that the first and second planks 244, 246 of the guiding member 24 are capable of supporting the guiding base 242. Contours of the first and second notches 244*a*, 246*a* are greater than an outer diameter of the body 222 of the pole 22; the first and second planks 244, 246 are rotatable about the body 222 of the pole 22 thereby. The first stopper 226 corresponding to the first notch 244*a* has a contour greater than that of the first notch 244*a*, and the second stopper 228 corresponding to the second notch 246*a* has a contour greater than that of the second notch 246*a*. In this way, the guiding base 242 of the guiding member 24 is restrained within a segment corresponding to the retaining face 2422 thereof and the threaded section 224. For clarity, the phrase "principle axis" may be regarded as the phrase "imaginary line" throughout the whole specification of the present application.

The movable member 26 is approximately annular, and fits around the threaded section 224 of the pole 22 between the pole 22 and the guiding member 24. To match each other, the interior wall of the shaft 14 and an exterior contour of the movable member 26 are designed to have a guiding slot and a guiding lump in a complementary manner. The guiding member 24 is designed to correspond to the exterior contour of the movable member 26 as well. When the shaft 14 rotates, the movable member 26 and the guiding member 24 are driven by the rotation of the shaft 14 to rotate synchronously in the same direction. The movable member 26 is rotatable about the pole 22, and is adapted to travel in a reciprocating manner both along the threaded section 224 of the pole 22 and the guiding base 242 of the guiding member 24. To simplify the arrangement, the position-fixing system 20 of the current embodiment is disposed inside the shaft 14, and the pole 22 and the shaft 14 are arranged in a collinear manner; however, such arrangement is not a limitation of the present invention. In practice, the position-fixing system 20 can be also installed outside of the shaft 14 to meet specific requirements, but is still drivable by the rotation of the shaft 14.

Figure 10A:
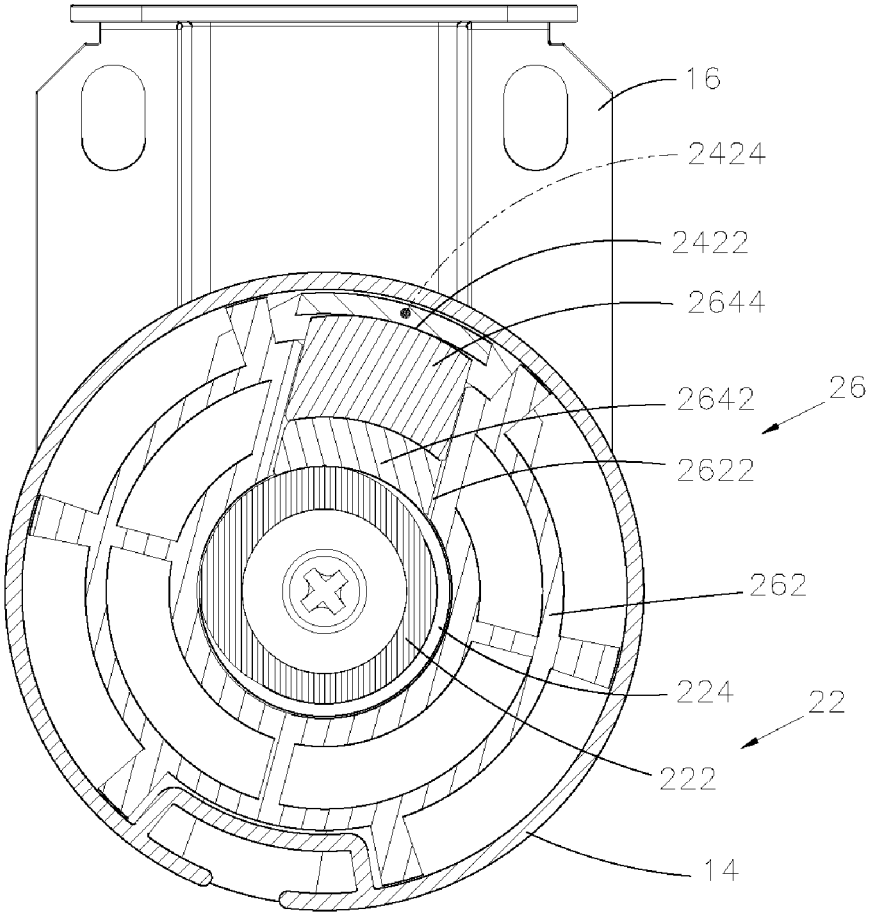
FIG. 10A is a sectional view along the 10A-10A line in FIG. 7.
Figure 10B:
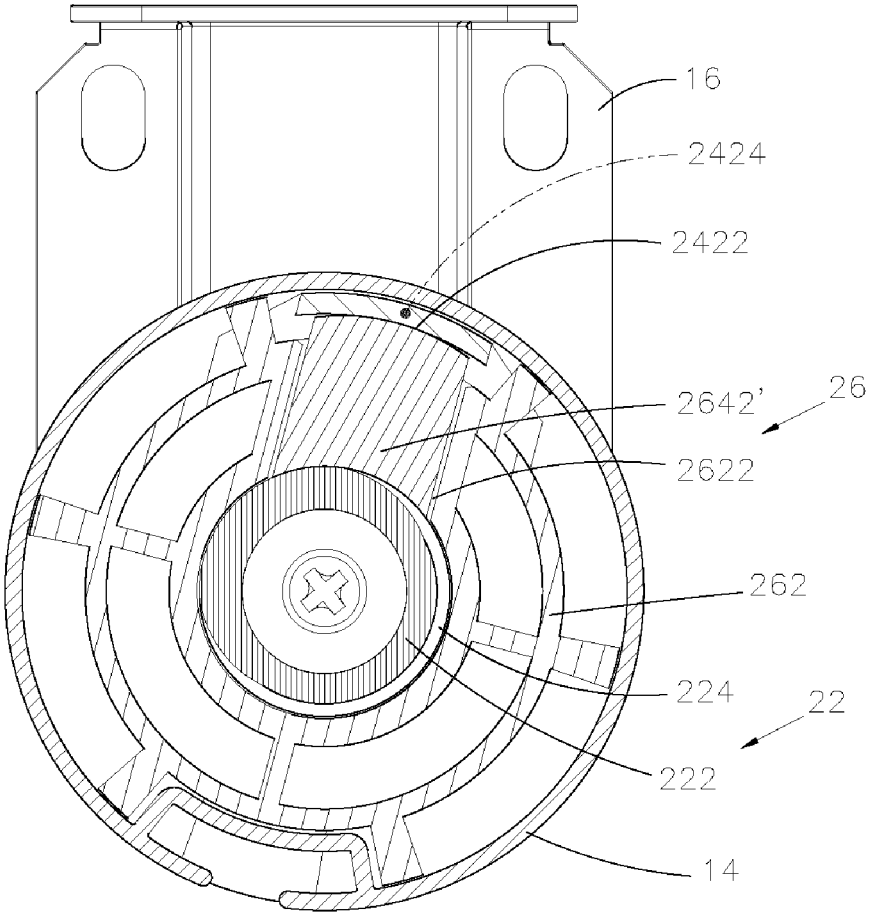
FIG. 10B is a sectional view, depicting an actuator assembly of another design different from that in FIG. 10A.

In the current embodiment, the movable member 26 includes a support portion 262 and an actuation assembly 264; the actuation assembly 264 includes an elastic member 2642 and an actuation portion 2644. The support portion 262 is annular and surrounds the threaded section 224. Therefore, a distance between the support portion 262 and the threaded section 224 of the pole 22 in a radial direction of the pole 22 is constant. The support portion 262 has a passage 2622 in the radial direction of the pole 22. The passage 2622 goes through an annular wall of the support portion 262 approximately in the radial direction of the pole 22, communicating the guiding base 242 of the guiding member 24 and the threaded section 224 of the pole 22. An end of the passage 2622 faces the retaining face 2422 of the guiding base 242. The elastic member 2642 and the actuation portion 2644 are received in the passage 2622 in a movable manner. The actuation portion 2644 is disposed between the elastic member 2642 and the retaining face 2422 of the guiding member 24, so that an end of the actuation portion 2644 keeps abutting against the retaining face 2422, while an opposite end of the actuation portion 2644 keeps abutting against the elastic member 2642. In addition, an end of the elastic member 2642 opposite to the actuation portion 2642 keeps abutting against the threaded section 224 of the pole 22, whereby to create a force which would push the actuation portion 2644 away from the pole 22, and a friction which would be applied onto the threaded section 224 of the pole 22 (the arrangements mentioned herein can be seen in FIG. 10A). The support portion 262 includes threads engaging with the threaded section 224. Thus, in the process of rotating the movable member 26 caused by the shaft 14, the movable member 26 rotates about the threaded section 224 of the pole 22 and travels back-and-forth along the threaded section 224 of the pole 22 at the same time. In practice, the actuation assembly 264 could be substituted by a single elastic member 2642', as illustrated in FIG. 10B. The single elastic member 2642' would deform as being suppressed by the retaining face 2422 of the guiding base 242, and therefore would create a friction between the single elastic member 2642' and the threaded section 224 of the pole 22, for an end of the single elastic member 2642' also abuts against the threaded section 224 of the pole 22. However, in the currently discussed practical case, another friction would be created upon the retaining face 2422 of the guiding base 242, leading to imperfect user experiences for operation the covering material, though it would not reduce the effect of fixing the position of the covering material.

Figure 3:
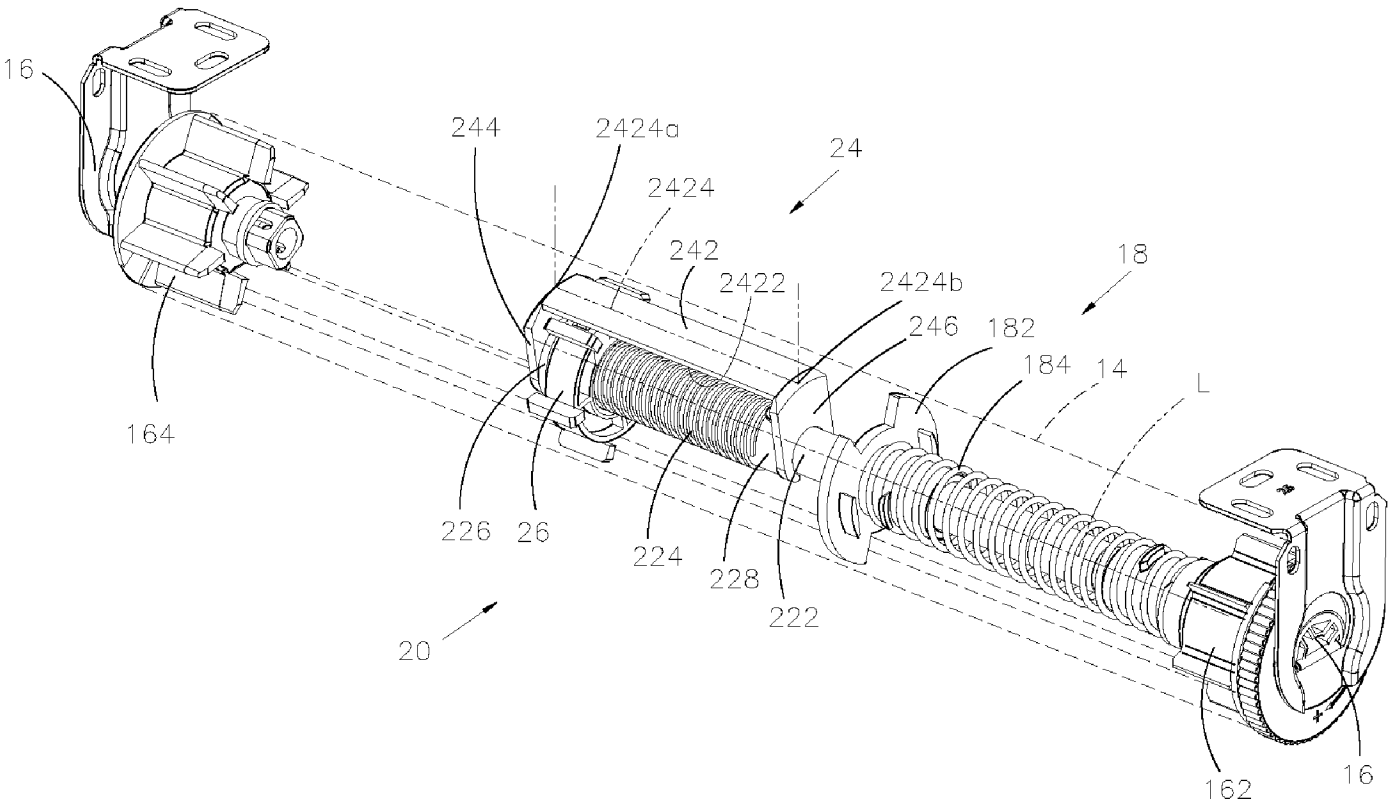
FIG. 3 is a perspective view of a position-fixing system of a first embodiment in accordance of the present invention, showing the arrangement of the position-fixing system in the window covering illustrated in FIG. 1.
Figure 4:
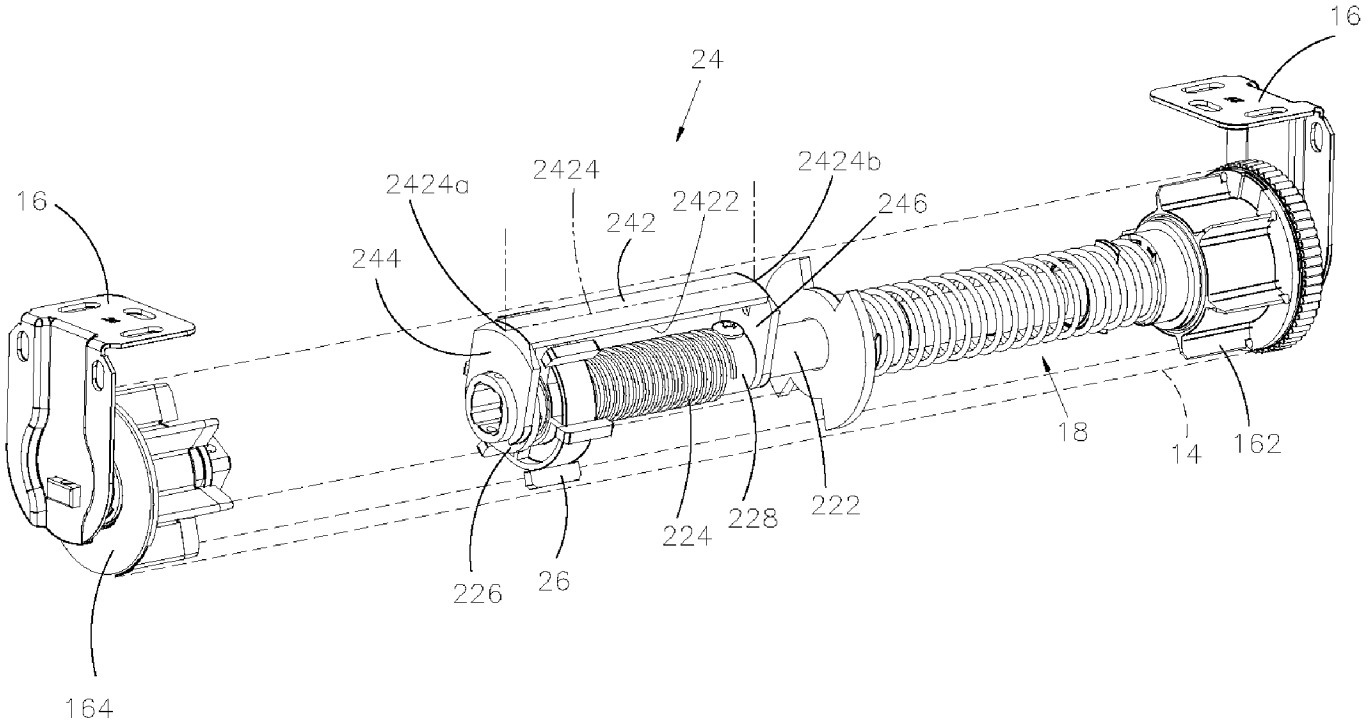
FIG. 4 is another perspective view of the position-fixing system of the first embodiment seen from another angle.
Figure 5:
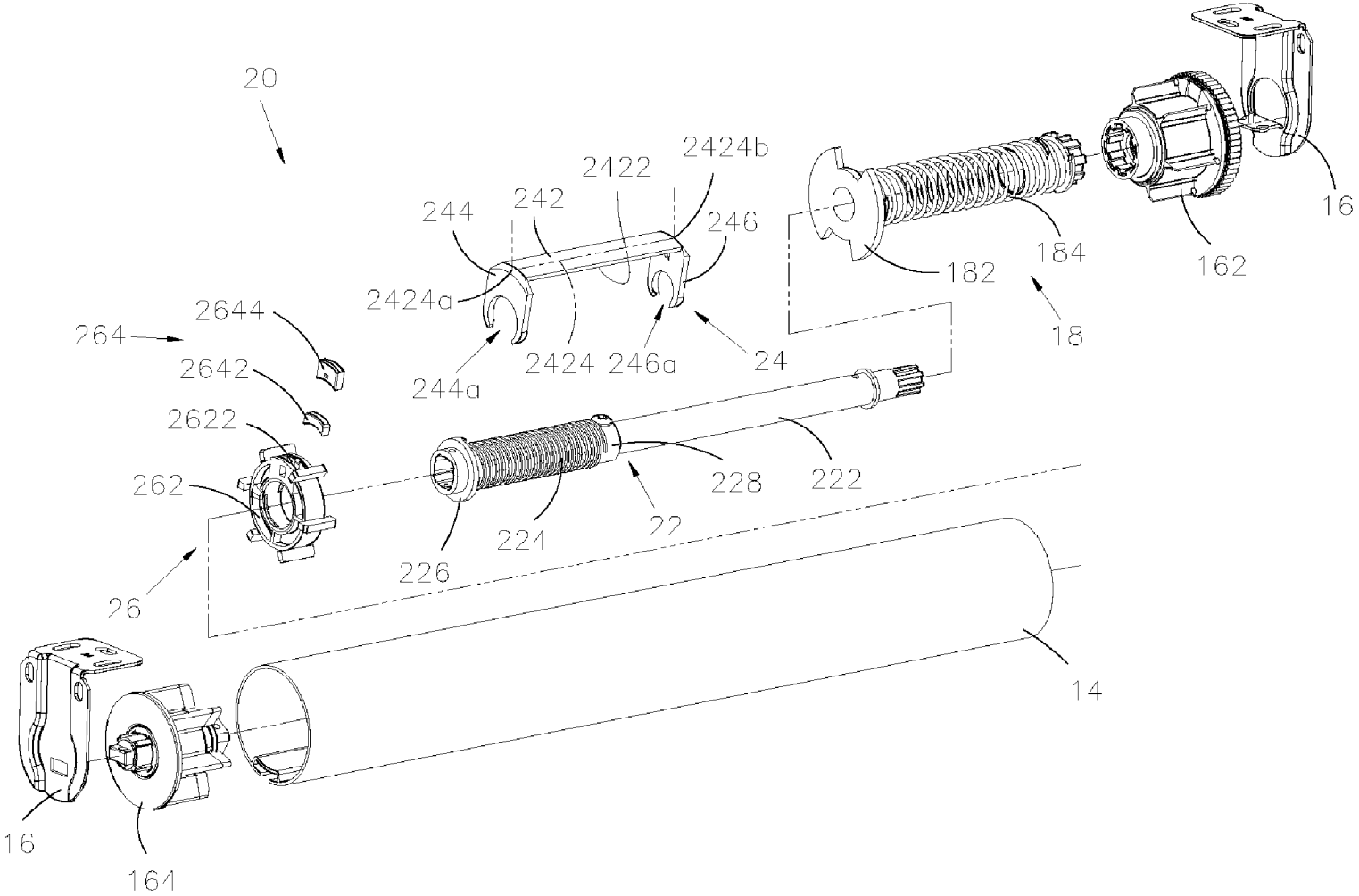
FIG. 5 is an exploded view of the position-fixing system shown in FIG. 4.
Figure 6:
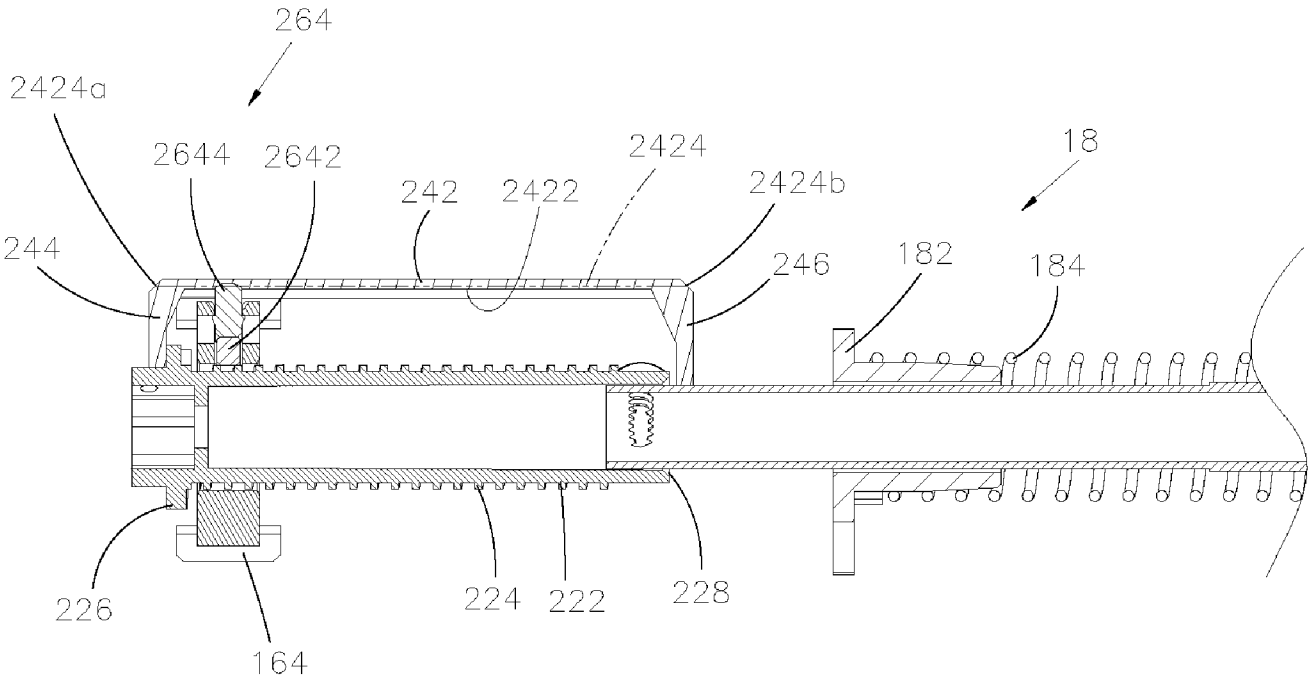
FIG. 6 is a partial sectional view of the position-fixing system shown in FIG. 3.
Figure 7:
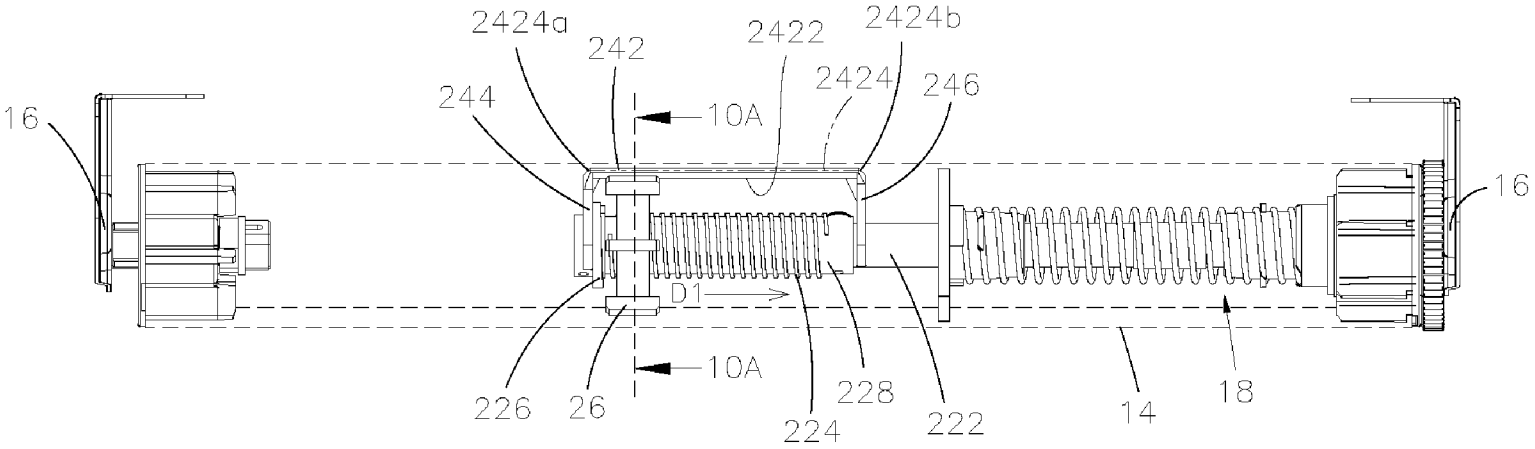
FIGS. 7-9 are side views showing the movements of a movable member of the position-fixing system of the first embodiment in accordance of the present invention, wherein an initial state of the position-fixing system is depicted in FIG. 7.
Figure 8:
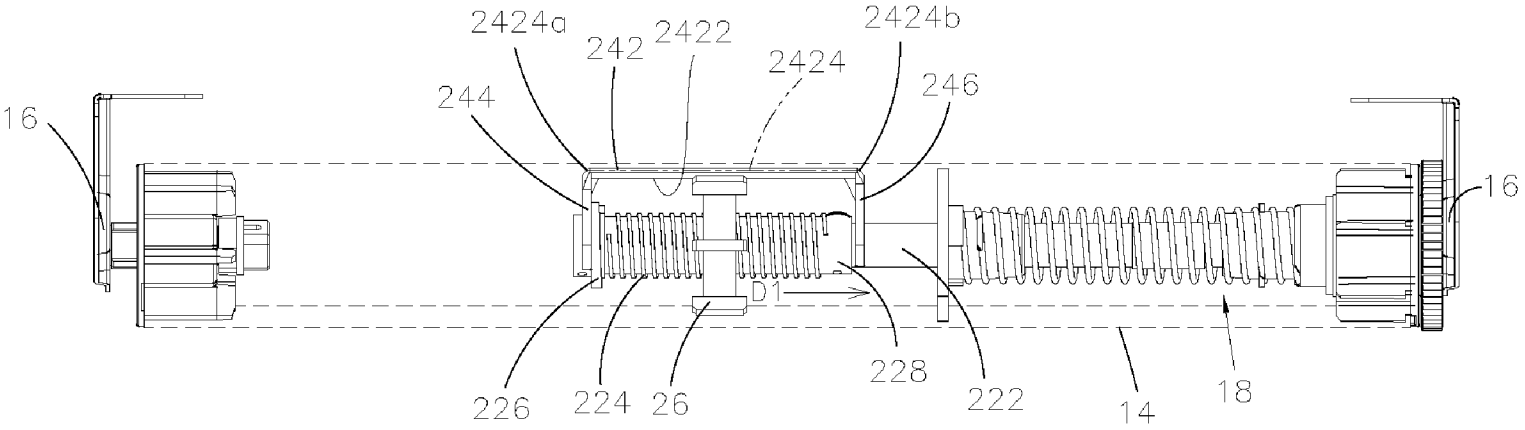
Figure 9:
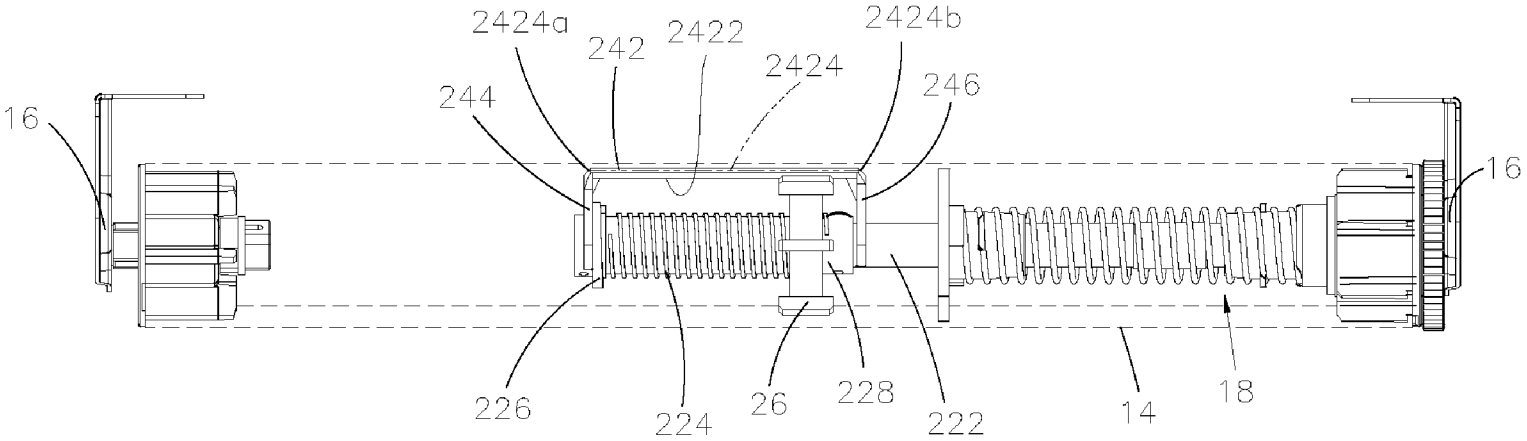

In the first embodiment, the state that the covering material 12 is retracted to the shaft 14, as depicted in FIG. 1, is defined as an initial state. The movable member 26 is adjacent to the first plank 244, and approximately corresponds to the first end 2424*a* of the principal axis 2424 of the guiding member 24. A first direction D1 is defined as a direction from the first end 2424*a* to the second end 2424*b* of the principal axis 2424 of the guiding member 24. Related arrangements and the states are illustrated in FIG. 3 to FIG. 5. When the covering material 12 is pulled downwards and starts to spread out from the shaft 14, the shaft 14 would be driven to rotate. The power mechanism 18 would be driven by the rotation of the shaft 14 through the drive member 182, and the power spring 184 would start to store the rewinding energy. The movable member 26 would be driven to rotate as well, traveling along the guiding member 24 in the first direction D1 as depicted in FIG. 7 to FIG. 9. In the end, the movable member 26 would arrive at the second end 2424*b* of the principal axis 2424 of the guiding member 24 as the covering material 12 is fully extended as depicted in FIG. 2. In the process of moving the movable member 26, the retaining face 2422 of the guiding member 242 would keep suppressing the actuation portion 2644 of the actuation assembly 264 inside the passage 2622 of the support portion 262, forcing the actuation portion 2644 to move backwards in the redial direction of the pole 22, so that the elastic member 2642 would be compressed as being pressed by the actuation portion 2644. As a result, the elastic member 2642 would have a force applied to the actuation portion 2644, and would abut against the threaded section 224, constantly creating a friction therebetween. When the operation of pulling down the covering material 12 stops, the friction between the elastic member 2642 and the threaded section 224, the rewinding force of the power spring 184 of the power mechanism 18, and a force provided by the covering material 12 to rotate the shaft 14 would come to an equilibrium. Therefore, the covering material 12 could stay at where it is when the operation of the covering material 12 stops. Conversely, when the covering material 12 is pushed upwards for retraction, the rewinding force of the power spring 184 of the power mechanism 18 would drive the shaft 14 to roll up the covering material 12, and the movable member 26 would start to rotate and to travel along the guiding base 242 in a direction opposite to the first direction D1. The actuation portion 2466 would keep pressing the threaded section 224 in the radial direction of the pole 22, suppressing the elastic member 2642. As a result, the friction between the elastic member 2642 and the threaded section 224 would be created consequently. When the operation of pushing up the covering material 12 stops, the friction between the elastic member 2642 and the threaded section 224, the rewinding force of the power spring 184 of the power mechanism 18, and the force provided by the covering material 12 to rotate the shaft 14 would come to an equilibrium. The covering material 12, again, would stay at where it is when the operation of the covering material 12 stops.

In the circumstances of the current embodiment, the window covering 10 can be operated to be lowered or raised by pulling down or pushing up the covering material 12. Once the operation of the covering material 12 stops, the covering material 12 could stop at its immediate position due to the friction created between the movable member 26 and the threaded section 224 of the pole 22.

A second embodiment of the present invention is illustrated in FIG. 11 to FIG. 15. The configurations and the arrangements referring the components in the second embodiment are approximately the same with those in the first embodiment. A position-fixing system 30 includes a pole 32, a guiding member 34, and a movable member 36. The movable member 36 fits around the pole 32, and is disposed between a guiding base 342 of the guiding member 34 and a threaded section 324 of the pole 32. The pole 32 includes a body 322, the threaded section 324, a first stopper 326, and a second stopper 328. The pole 32 is defined to have an extension axis L collinear with a central axis of the body 322. The threaded section 324 is formed around the body 322; the first stopper 326 and the second stopper 328 are respectively adjacent to two ends of the threaded section 324. The guiding member 34 includes a guiding base 342, and a first plank 344 and a second plank 346 respectively provided at two ends of the guiding base 342 for supporting the guiding base 342. The guiding base 342 has a retaining face 3422, and is defined to have a principal axis 3424. The principal axis 3424 of the guiding member 34 and the extension axis L of the pole 32 extend in the same direction, and are parallel to each other. The principal axis 3424 is defined to have two ends, including a first end 3424*a* and a second end 3424*b*, which respectively correspond to the first plank 344 and the second plank 346, whereby the first plank 344 and the second plank 346 are limited by the first stopper 326 and the second stopper 328 respectively. The guiding base 342 of the guiding member 34 is restrained within a segment between the retaining face 3422 and the threaded section 324. The movable member 36 is approximately annular, and includes a support portion 362 and an actuation assembly 364. The actuation assembly 364 includes an elastic member 3642 and an actuation portion 3644. The elastic member 3642 and the actuation portion 3644 arte received in a passage 3622 of the support member 362 in a movable manner, and the actuation portion 3644 is disposed between the elastic member 3642 and the retaining face 3422 of the guiding base 342. An end of the actuation portion 3644 keeps contacting the retaining face 3422, while an opposite end of the actuation portion 3644 suppresses the elastic member 3642. An end of the elastic member 3642 opposite to the actuation portion 3644 keeps abutting against the threaded section 324 of the pole 32, and a force is created for pushing the actuation portion 3644 away from the pole 32 thereby.

The difference between the first and second embodiments is that, in the second embodiment, the retaining face 3422 of the guiding base 342 of the guiding member 34 inclines and approaches the threaded section 324 of the pole 32 in a direction from the first end 3424*a* to the second end 3424*b* along the principal axis 3424, which means a distance between the retaining face 3422 and the principal axis 3424 increases gradually in the direction from the first end 3424*a* to the second end 2424*b* along the principal axis 3424. In more details, the guiding base 342 is homogeneous and solid, wherein a lateral side thereof opposite to the retaining face 3422 approximately abuts against the interior wall of the shaft 14 of the window covering 10. The guiding base 342 is getting thicker as getting closer to the power mechanism 18, so that a distance between the retaining face 3422 of the guiding base 342 and the threaded section 324 of the pole 32 gradually decreases in a direction toward the power mechanism 18, wherein a thickness of the guiding base 342 is measured in the radial direction of the pole 32. In other words, a cross-sectional area of the guiding base 342 increases in a direction toward the power mechanism 18 along the principal axis 3424 (or we can say, in a direction along the extension axis L of the pole 322). The direction from the first end 3424*a* (or the first plank 344) to the second end 2424*b* (or the second plank 346) is also defined as a first direction D1, which means, the direction D1 is the direction that the cross-sectional area of the guiding base 342 increases.

In the current embodiment, the pole 32, the guiding member 34, the support portion 362, and the actuation portion 3644 are made of solid materials, which are not likely to deform, while the elastic member 2642 is made of resilient materials with inherent elasticity. As the thickness of the guiding base 342 gradually increases in the direction D1, the retaining face 3422 gradually approaches the pole 32. Because the actuation portion 3644 and the pole 32 are made of solid materials which are not deformable in response to the gradual increase of the thickness of the guiding base 342, they would transfer a gradually increasing suppression caused by the gradual increase of the thickness of the guiding base 342 to the elastic member 3642. The elastic member 3462, which is inherently elastic, would deform and react in response to the gradually increasing suppression. Therefore, a friction between the elastic member 3462 and the pole 32 would be created in response to the increasing thickness of the guiding base 342. In principle, the elastic member 3462 could be made of any materials or components with the properties of reversibility and compressibility, such as springs, rubber, or silicone.

Figure 11:
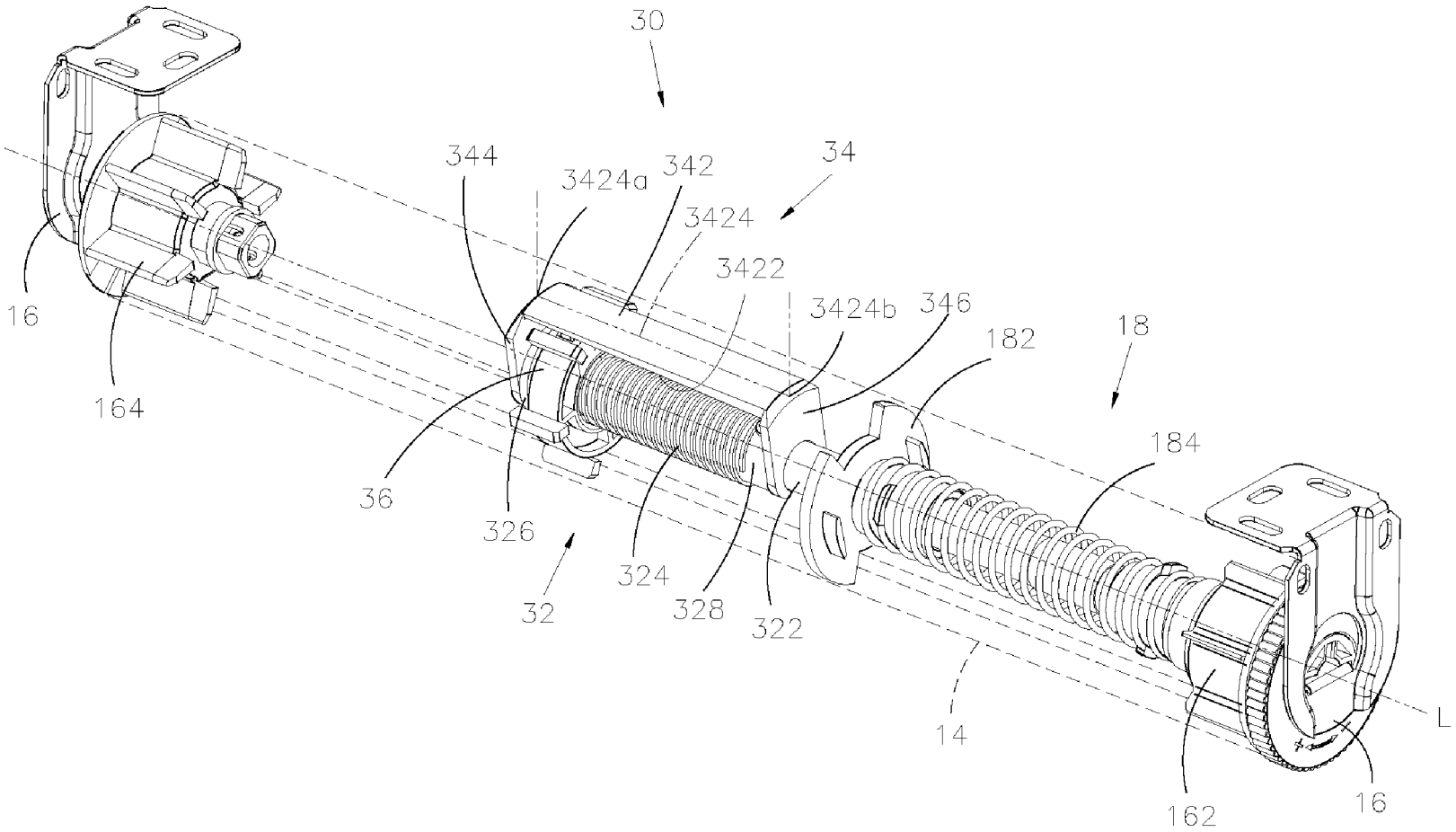
FIG. 11 is a perspective view of a position-fixing system of a second embodiment in accordance of the present invention, showing the arrangement of the position-fixing system in the window covering illustrated in FIG. 1.
Figure 12:
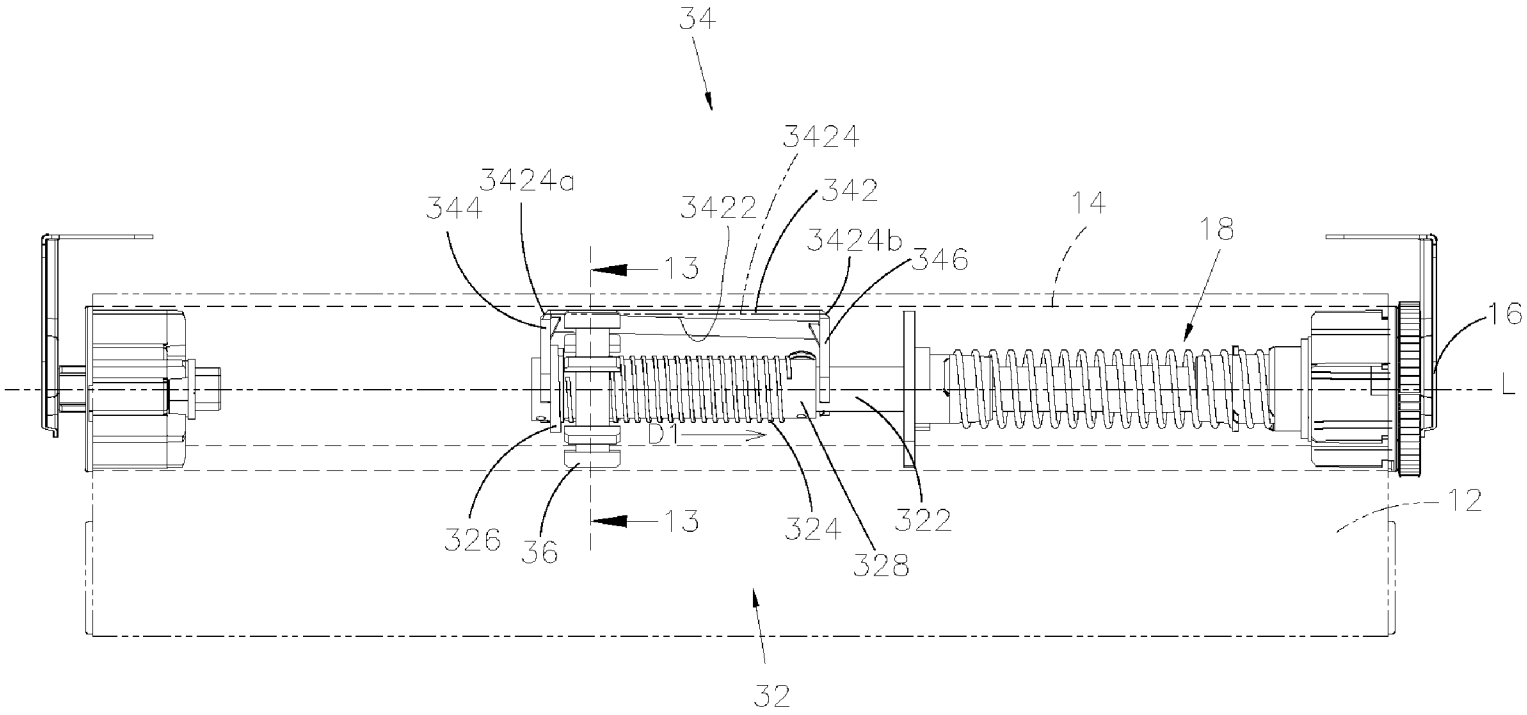
FIG. 12 is a front view of the position-fixing system of the second embodiment in accordance of the present invention, showing the arrangement of the position-fixing system in the window covering illustrated in FIG. 1.
Figure 13:
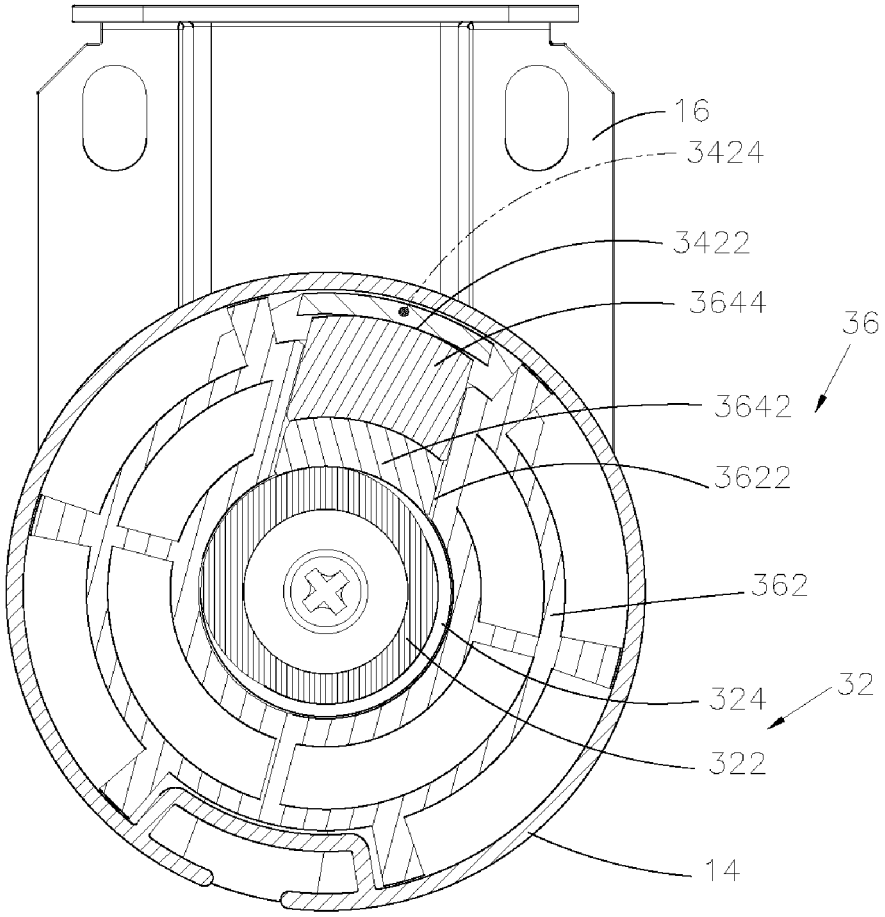
FIG. 13 is a sectional view along the 13-13 line in FIG. 12.
Figure 14:
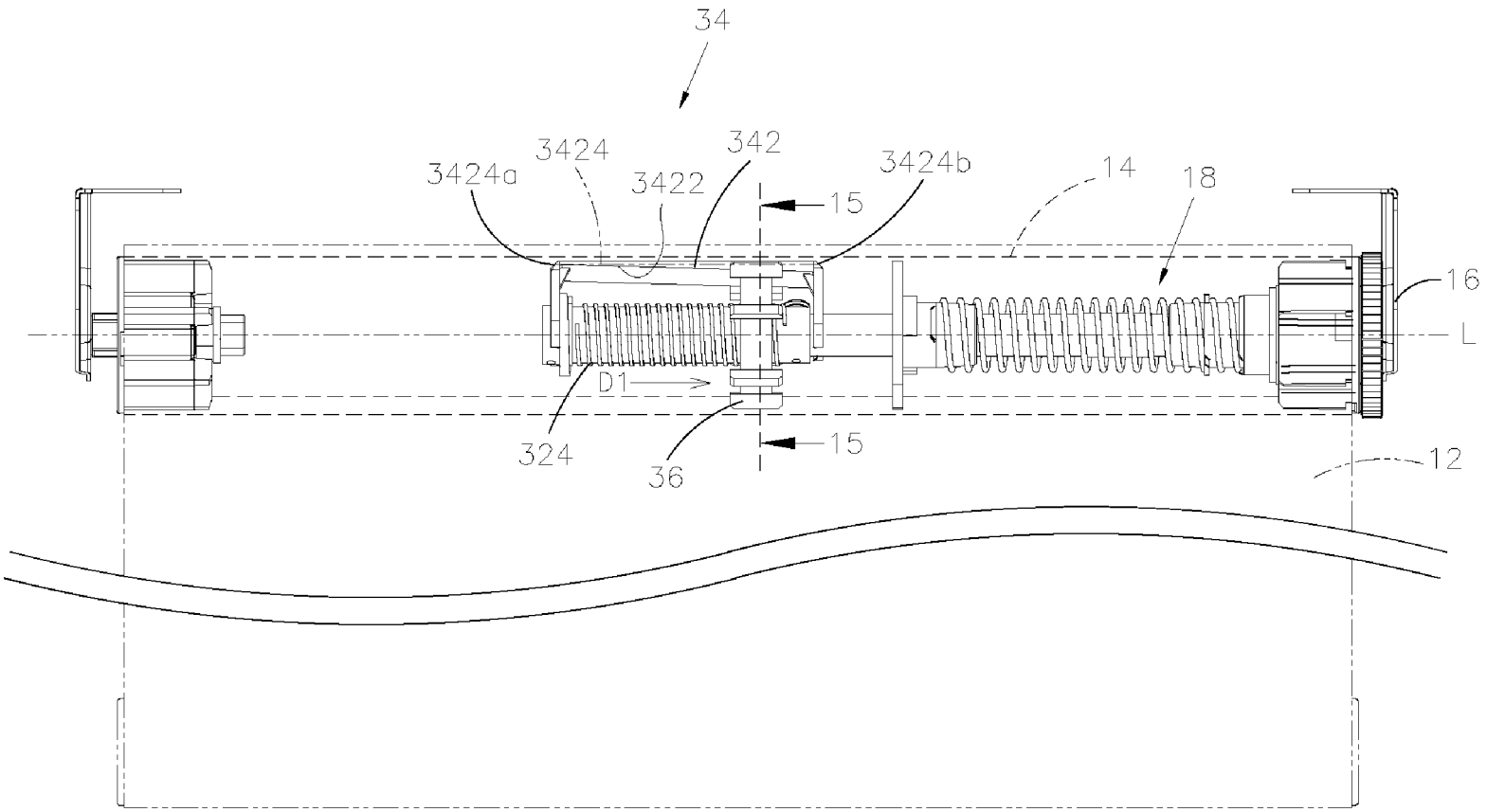
FIG. 14 is a front view of the position-fixing system of the second embodiment in accordance of the present invention, showing the status of position-fixing system of the second embodiment in accordance of the present invention in the window covering illustrated in FIG. 2.
Figure 15:
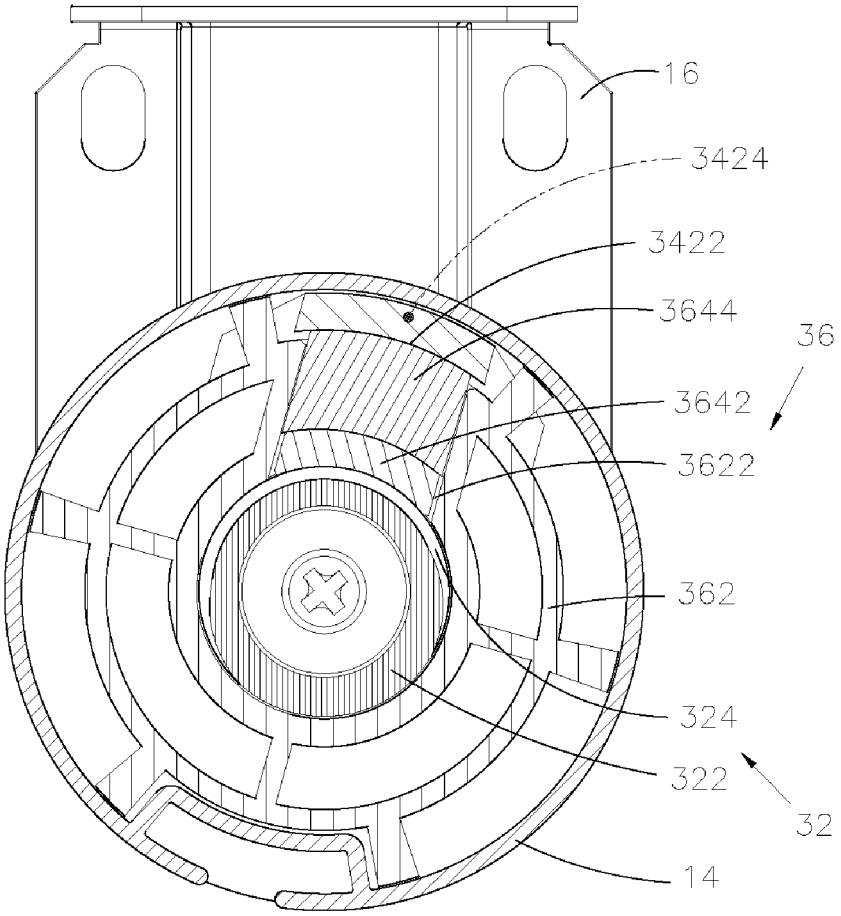
FIG. 15 is a sectional view along the 15-15 line in FIG. 14.

In the current embodiment, the state when the covering material 12 is retracted to the shaft 14, as depicted in FIG. 1, is defined as an initial state. The movable member 36 approximately corresponds to the first end 3424*a* of the guiding member 34, as illustrated in FIG. 11 to FIG. 13. When the covering material 12 is pulled downwards, the covering material 12 would be spread out from the shaft 14 to drive the shaft 14 to rotate. The power mechanism 18 is driven by the rotation of the shaft 14 to store the rewinding energy, and the movable member 36 is driven to rotate consequently. At this time, the movable member 36 would travel along the guiding member 34 in the first direction D1, i.e. the direction that the cross-sectional area of the guiding base 342 increases, and would finally come close to the second end 3424*b*, as illustrated in FIGS. 2, 14 and 15. The actuation portion 3644 in the passage 3622 would be suppressed due to the gradual increase of the thickness of the guiding base 342 and would move toward the threaded section 324 of the pole 32, compressing the elastic member 3642. The friction between the threaded section 324 and the elastic member 3642 increases gradually thereby. In the process of spreading out the covering material 12, once the operation of the covering material 12 stops, the friction between the elastic member 3642 and the threaded section 324, the rewinding force of the power spring 184 of the power mechanism 18, and a force provided by the covering material 12 to rotate the shaft 14 would come to an equilibrium. As a result, the covering material 12 could stay at where it is when the operation of the covering material 12 stops. Conversely, when the covering material 12 is pushed upwards to be retracted, the rewinding force of the power spring 184 of the power mechanism 18 would drive the shaft 14 to retract the covering material 12, and the movable member 36 would be driven by the rotation of the shaft 14, whereby to travel along the guiding member 342 in a direction opposite to the first direction D1 (a direction that the cross-sectional area of the guiding base 342 decreases). The elastic member 3642 would create the force in response to the suppression from the actuation portion 3644, whereby to push the actuation portion 3644 in a direction away from the pole 32. The suppression would decrease when the movable member 36 travels in the direction opposite to the first direction D1. At the same time, the friction between the elastic member 3642 and the threaded section 324 decreases in response to the decrease of the suppression. When the operation of the covering material 12 stops, the friction between the elastic member 3642 and the threaded section 324, the rewinding force of the power spring 184 of the power mechanism 18, and the force provided by the covering material 12 to rotate the shaft 14 would come to an equilibrium. The covering material 12, again, could stay at where it is when the operation of the covering material 12 stops.

As the covering material 12 extends, the force driving the shaft 14 to rotate provided by the covering material 12 would become stronger. Although the rewinding energy is stored by the power spring 184 of the power mechanism 18, it is actually not sufficient to counterbalance the force provided by the covering material 12 for driving the shaft 14. The friction between the elastic member 3642 and the threaded section 324 in these embodiments of the present invention would gradually increase to help the power spring 184 of the power mechanism 18 to overcome the gradually increasing force caused by the gradual expansion of the covering material 12, whereby to achieve the purpose of precise fixing the position of the covering material 12. The same purpose could be also achieved in the situation when the covering material 12 is being raised.

A third embodiment of the present invention is illustrated in FIG. 16 to FIG. 21. A position-fixing system 40, which is roughly the same with the prior embodiments, is received in the window covering 10, and includes a pole 42, a guiding member 44, and a movable member 46. The pole 42 of the position-fixing system 40 is mounted to a bracket 16; the pole 42 includes a body 422 and a threaded section 424 formed around the body 422. The threaded section 424 is provided with a first stopper 426 and a second stopper 428. The guiding member 44 is adjacent to the pole 42. The guiding member 44 includes a guiding base 442 with a retaining face 4422, and is defined to have a principal axis 4424. The difference between the current embodiment and the prior embodiments is that, the guiding member 44 further includes a rib 4426 provided on a side opposite to the retaining face 4422. With the rib 4426, a cross-section of the guiding base 4424 is approximately like an inverted T shape. The rib 4426 abuts against the interior wall of the shaft 14. The principal axis 4424 extends along the rib 4426 in the same direction with the extension axis L of the body 422, and is parallel to the extension axis L. Two ends of the principal axis 442 are respectively defined as a first end 4424*a* and a second end 4424*b*, which respectively correspond to a first plank 444 and a second plank 446 of the guiding member 44. The first plank 444 and the second plank 446 are limited by the first stopper 426 and the second stopper 428 respectively, and the guiding base 442 of the guiding member 44 is restrained within a segment between the first and second stoppers 444, 446 in accordance with that between the retaining face 4422 and the threaded section 424. A direction from the first end 4424*a* (or the first plank 444) to the second end 4424*b* (or the second plank 446) is defined as a first direction D1. A thickness of the rib 4426 increases in the first direction D1, and the retaining face 4422 of the guiding base 442 gets closer to the threaded section 424 of the pole 42 in the first direction D1 thereby, wherein the thickness is measured in the radial direction of the pole 42.

The movable member 46, similar to those of the prior embodiments, is approximately annular, and includes a support portion 462 and an actuation assembly 464. The actuation assembly 464 is received in a passage 4622 of the support portion 462 in a movable manner, and includes an elastic member 4642 and an actuation portion 4644. The actuation portion 4644 is disposed between the elastic member 4642 and the retaining face 4422 of the guiding base 442, and the retaining face 4422 keeps abutting against an end of the actuation portion 4644. An opposite end of the actuation portion 4644 keeps abutting against the elastic member 4642, and an end of the elastic member 4642 opposite to the actuation portion 4642 keeps abutting against the threaded section 424 of the pole 42 for creating a force to push the actuation portion 4644 away from the pole 42 and, at the same time, a friction between the elastic member 4642 and the threaded section 424.

Figure 16:
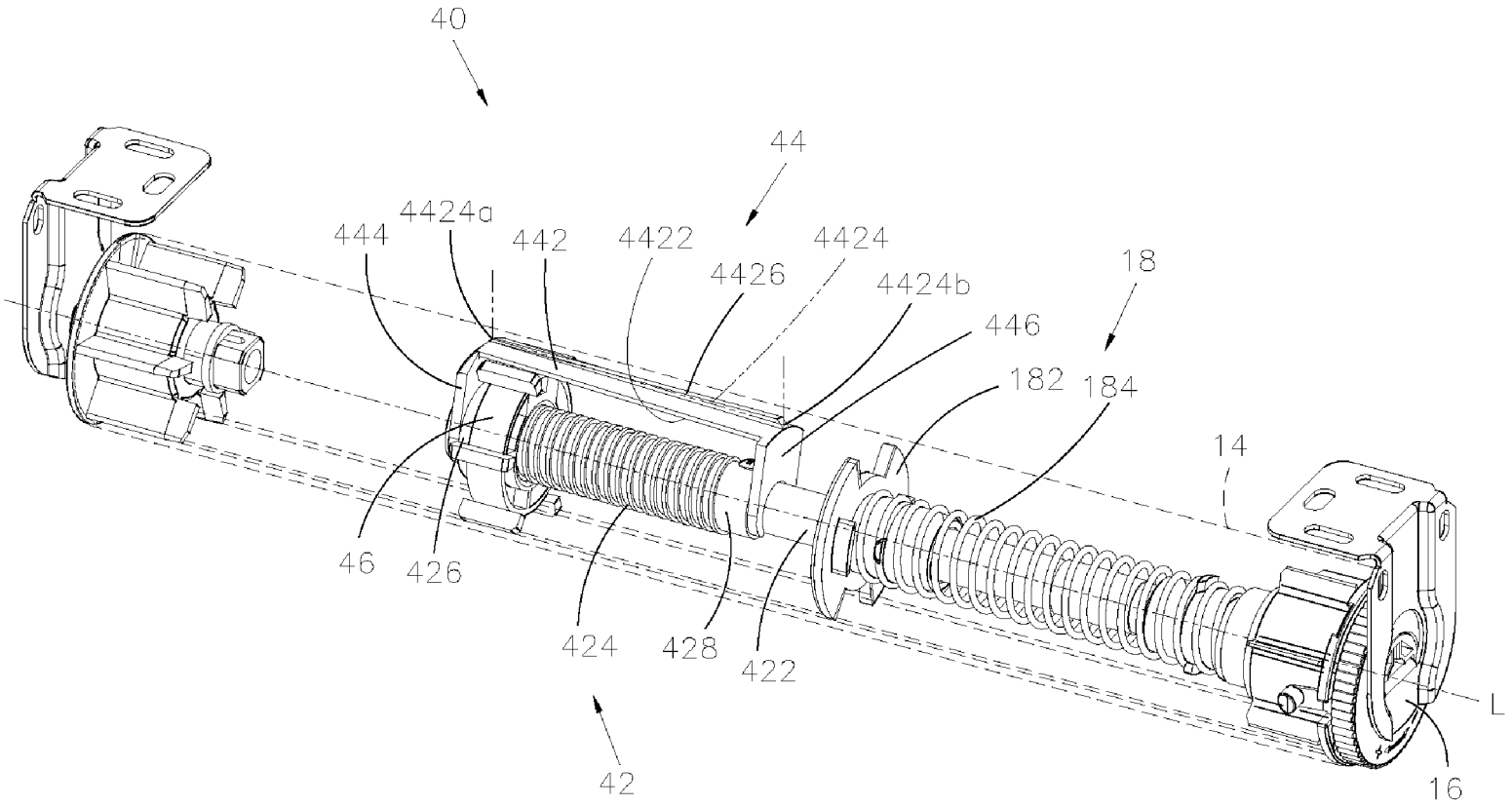
FIG. 16 is a perspective view of a position-fixing system of a third embodiment in accordance of the present invention, showing the arrangement of the position-fixing system in the window covering illustrated in FIG. 1.
Figure 17:
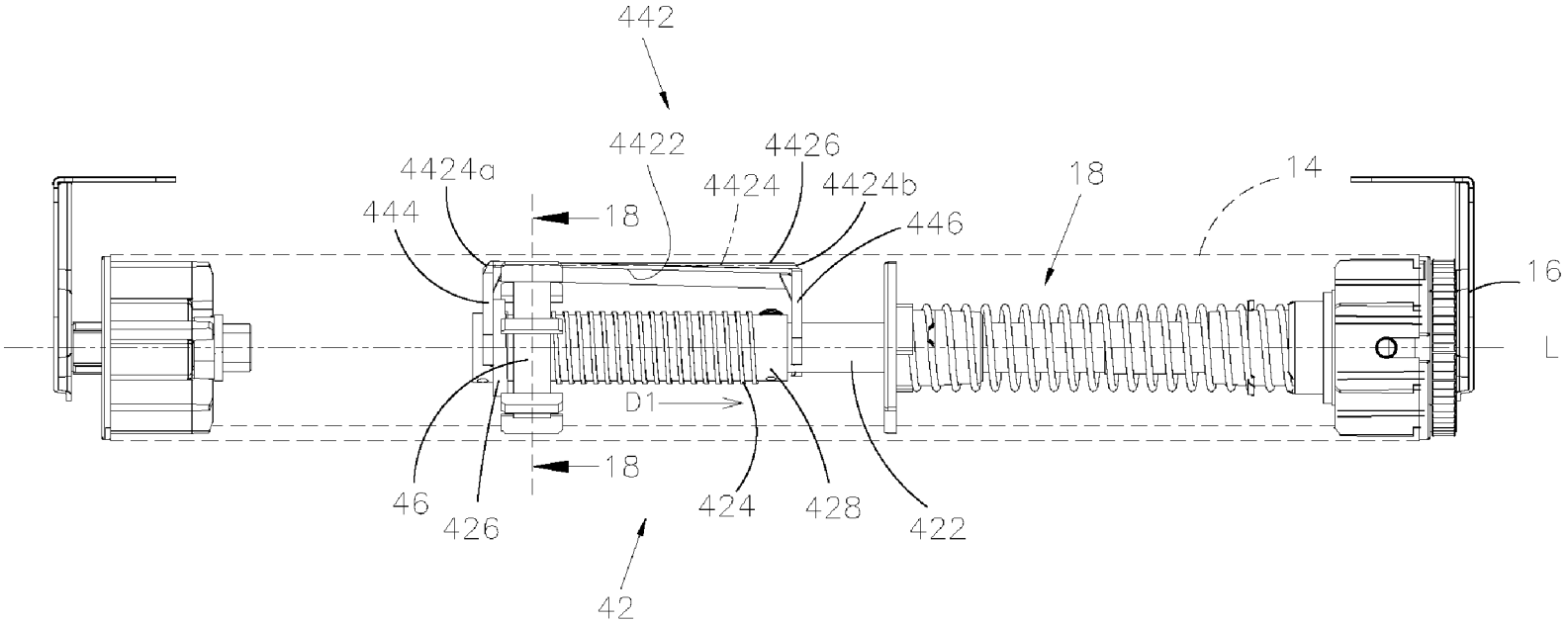
FIG. 17 is a front view of the position-fixing system of the third embodiment in accordance of the present invention, showing the position-fixing system of the third embodiment of the present invention in the window covering illustrated in FIG. 1.
Figure 18:
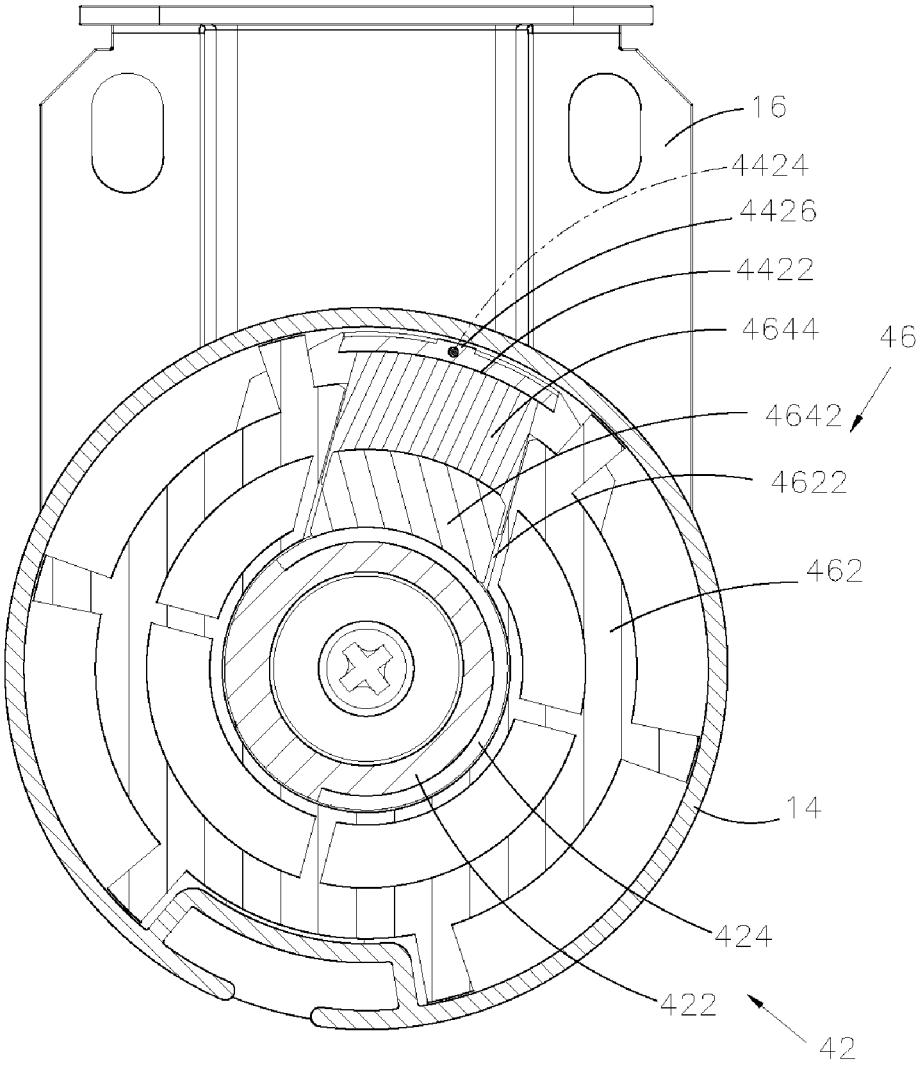
FIG. 18 is a sectional view along the 18-18 line in FIG. 17.
Figure 19:
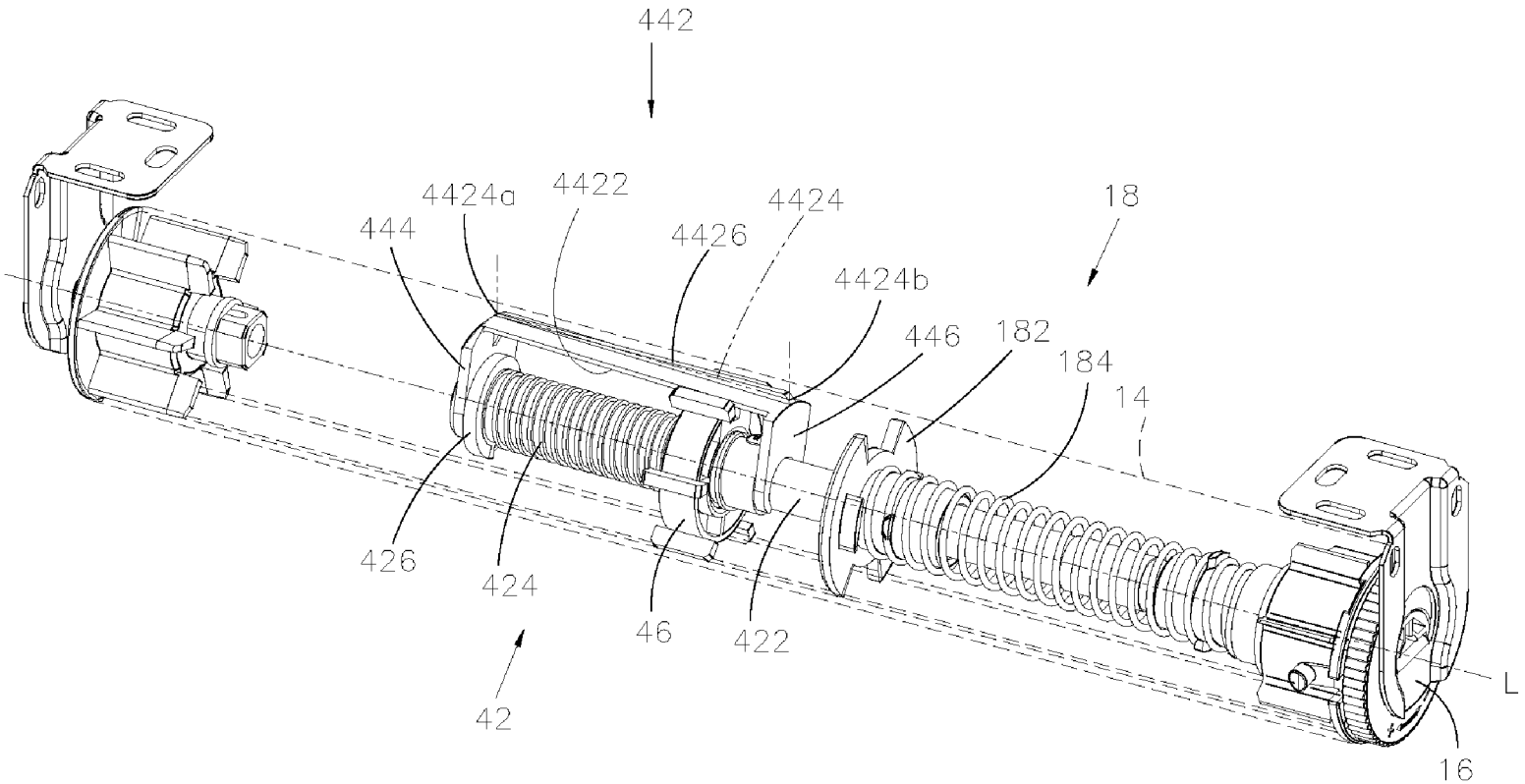
FIG. 19 is a sectional view of the position-fixing system of the third embodiment in accordance of the present invention, showing the arrangement of the position-fixing system in the window covering illustrated in FIG. 2.
Figure 20:
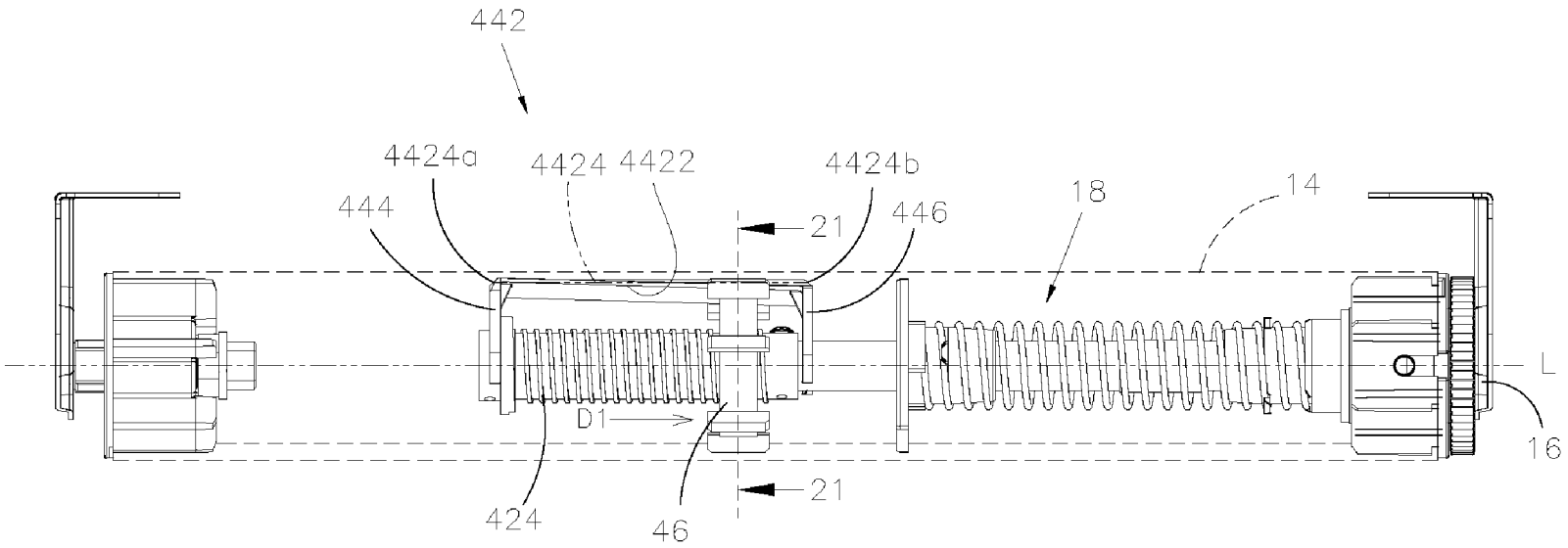
FIG. 20 is a front view of the position-fixing system of the third embodiment in accordance of the present invention, showing the status of the position-fixing system of the third embodiment in accordance of the present invention in the window covering illustrated in FIG. 2.
Figure 21:
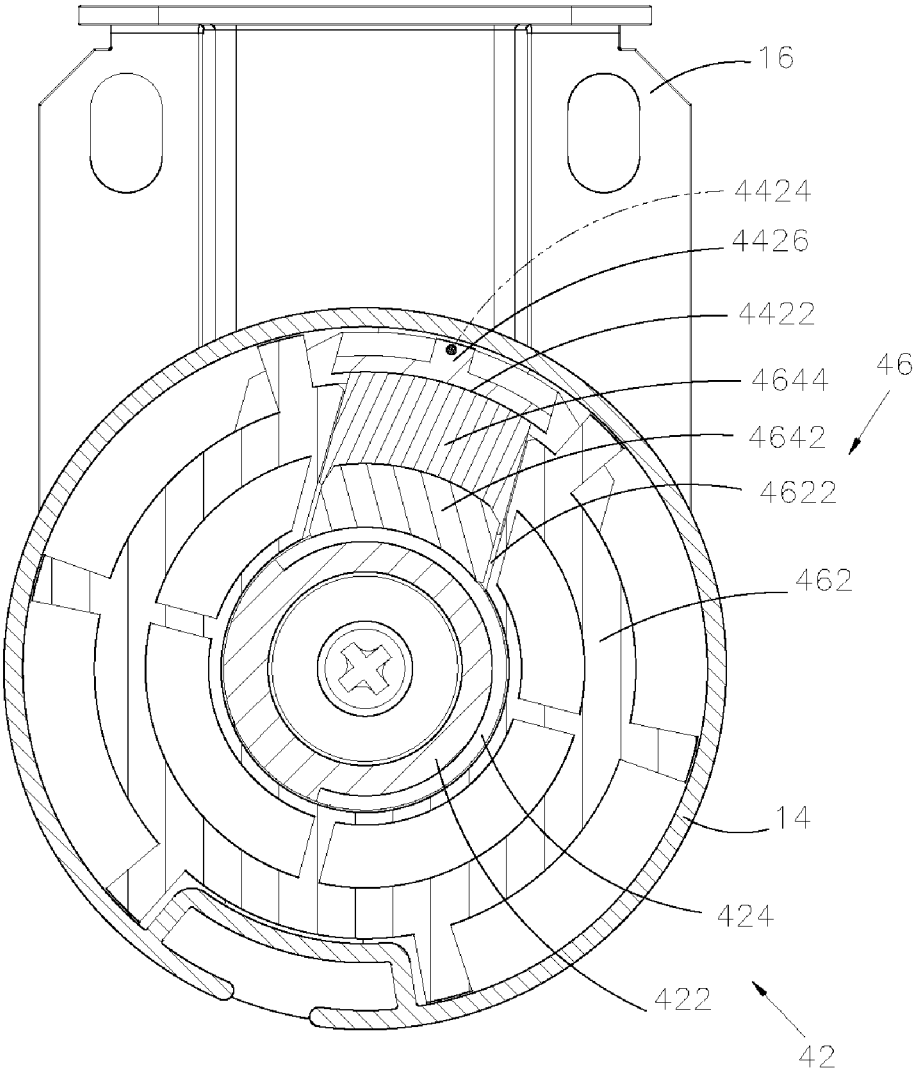
FIG. 21 is a sectional view along the 21-21 line in FIG. 20.
Figure 22:
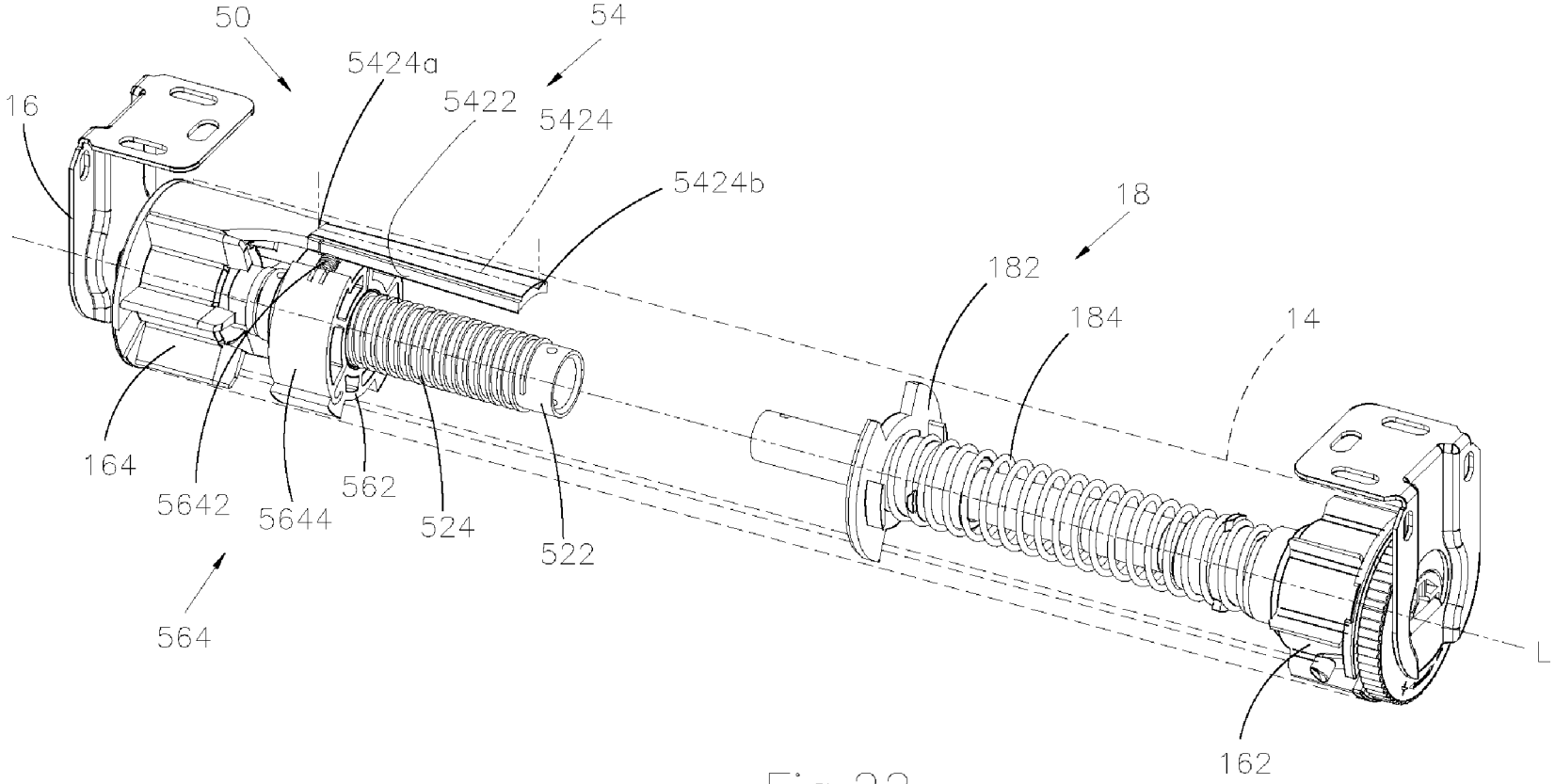
FIG. 22 is a perspective view of a position-fixing system of a fourth embodiment in accordance of the present invention, showing the arrangement of the position-fixing system in the window covering illustrated in FIG. 1.
Figure 23:
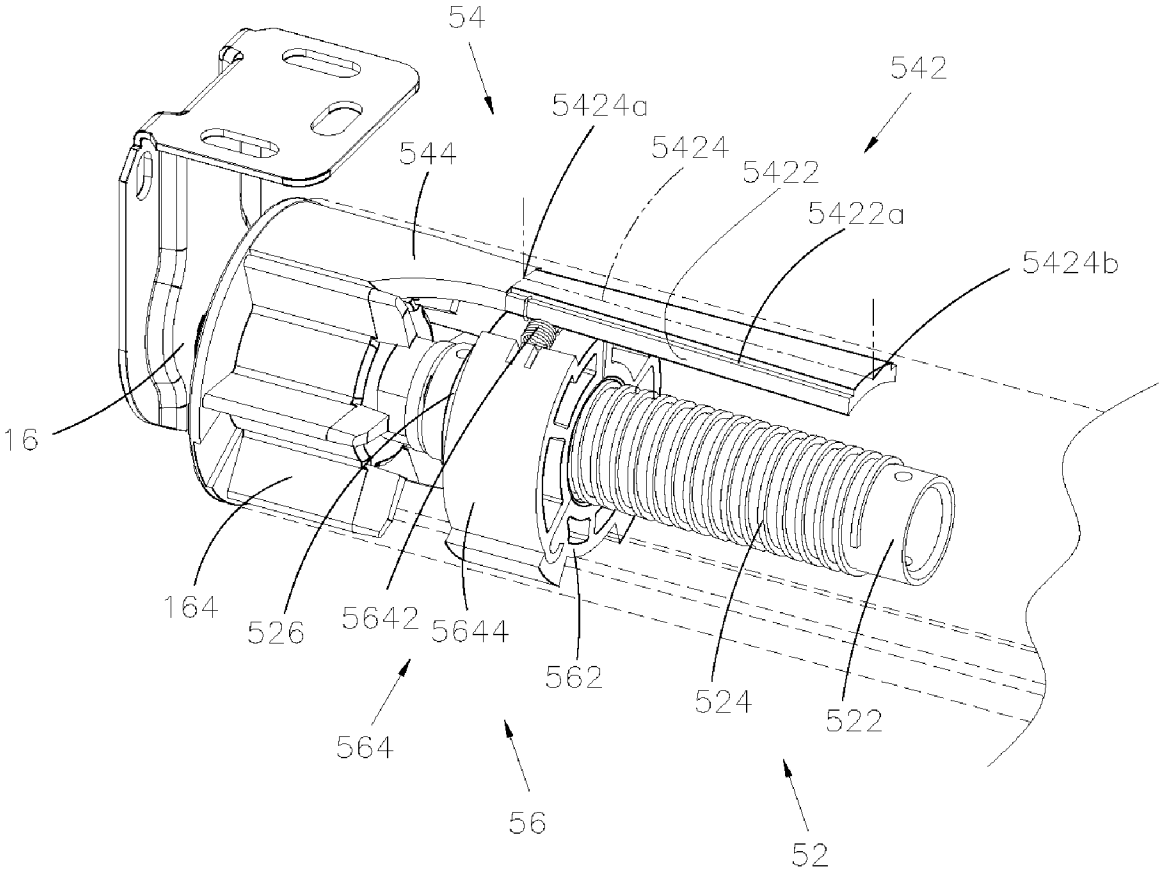
FIG. 23 is an enlarged view of the position-fixing system of the fourth embodiment shown in FIG. 22.
Figure 24:
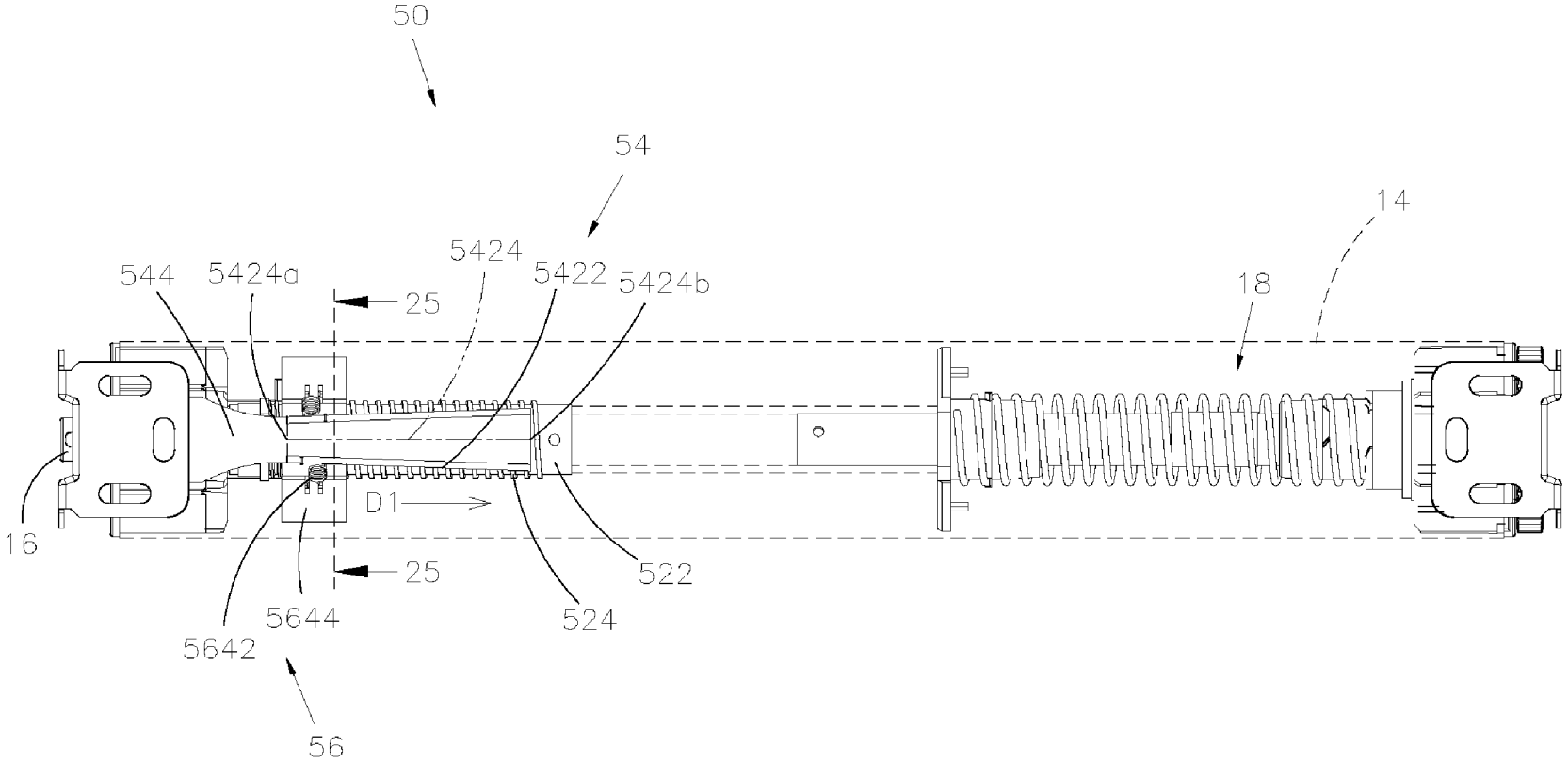
FIG. 24 is a top view of FIG. 22.
Figure 25:
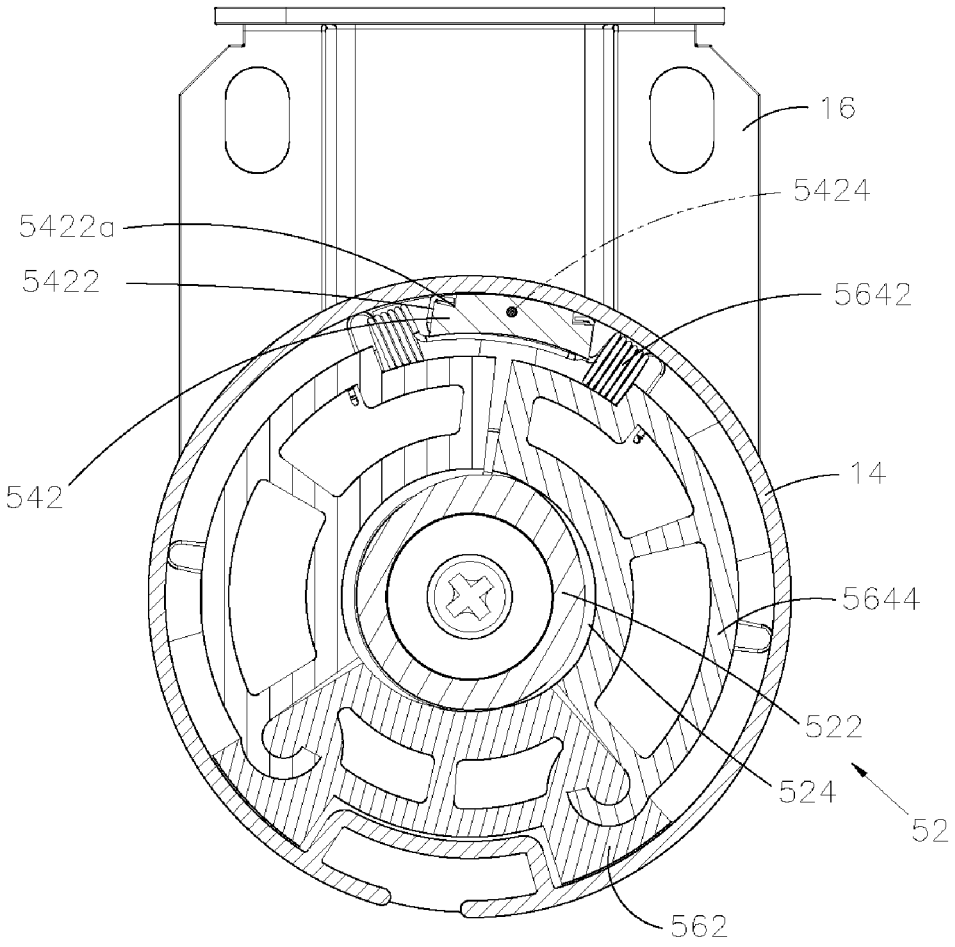
FIG. 25 is a sectional view along the 25-25 line in FIG. 24.

The state when the covering material 12 retracted to the shaft 14 is, again, defined as an initial state. The movable member 46 is approximately adjacent to the first plank 444, and corresponds to the first end 4424*a* of the principal axis 4424 of the guiding member of the 44, as illustrated in FIG. 16 to FIG. 18. When the covering material 12 is pulled downwards, the movable member 46 is driven to travel along the threaded section 424 of the guiding member 44 in the first direction D1 and also to abut against the retaining face 4424 of the guiding base 442. In the process of moving the movable member 46, the actuation portion 4644 of the actuation assembly 464 inside the passage 4622 of the support portion 462 is gradually suppressed by the retaining face 4422 of the guiding member 442, while the retaining face 4422 pushes the actuation portion 4644 to move gradually toward the threaded section 424 in the redial direction of the pole 22. At the same time, the elastic member 4642 is compressed gradually due to the gradual suppression from the actuation portion 4644, and the friction between the elastic member 4642 and the threaded section 424 gradually increases thereby. The movable member 46 could keep being moved until the covering material 12 fully extend, as illustrated in FIGS. 2, 19 to 21, in which the movable member 46 arrives at the second end 4424*b* of the principal axis 4424 of the guiding member 44. When the operation of pulling down the covering material 12 stops, the friction between the elastic member 4642 and the threaded section 424, the rewinding force of the power spring 184 of the power mechanism 18, and a force caused by the covering material 12 to rotate the shaft 14 would come to an equilibrium. The covering material 12 would stay at where it is when the operation of the covering material 12 stops. Conversely, when the covering material 12 is pushed upwards to be retracted, the rewinding force of the power spring 184 of the power mechanism 18 would drive the shaft 14 to retract the covering material 12, and the movable member 46 driven by the shaft 14 would start to travel along the guiding base 442 in a direction opposite to the first direction D1, so that the elastic member 4642 provides the force for pushing the actuation portion 4644 away from the pole 42. As a result, the suppression made by the actuation portion 4644 upon the elastic member 4642 would decrease gradually because the movable member 46 travels in the direction opposite to the first direction D1, and the friction between the elastic member 4642 and the threaded section 424 would gradually decrease. When the operation of pushing up the covering material 12 stops, the friction between the elastic member 4642 and the threaded section 424, the rewinding force of the power spring 184 of the power mechanism 18, and the force caused by the covering material 12 to rotate the shaft 14 would come to an equilibrium. The covering material 12, again, would stay at the immediate position as required.

A fourth embodiment of the present invention is illustrated in FIG. 22 to FIG. 28. The position-fixing system 50 is arranged in the window covering 10 as in the prior embodiments, and includes a pole 52, a guiding member 54, and a movable member 56. The pole 52 includes a body 522, a threaded section 524 surrounding the body, and a first stopper 526 disposed at an end of the threaded section 524. The pole 522 is mounted to one of the brackets 16 of the window covering 10, and stays stable in comparison to the window covering 10. The guiding member 54 is adjacent to the threaded section 524 of the pole 52; the guiding member 54 includes a guiding base 542 and a first plank 544. The first plank 544 engages with one of the plugs 164 of the bracket 16 to support the guiding base 542, and a retaining face 5422 of the guiding base 542 corresponding to the threaded section 524 of the pole 52. The guiding member 54 is defined to have a principal axis 5424 passing through the guiding base 542. The principal axis 5424 extends in the same direction with an extension axis L of the body 522, and is parallel to the extension axis L, wherein the extension axis L extends along a central axis of the pole 52 in a collinear manner. Two ends of the principal axis 5424 are respectively defined as a first end 5424*a* and a second end 5424*b*, and a first direction D1 is defined as from the first end 5424*a* to the second end 5424*b* along the principal axis 5424. The first end 5424*a* is provided at where the first plank 544 joints the guiding base 542, and corresponds to the first stopper 526 of the pole 52. In the current embodiment, the number of the retaining faces 5422 of the guiding base 542 is two. The retaining faces 5422 are provided at on a side of the principal axis 5424, and are respectively at two lateral sides of the principal axis 5424, arranged between the first end 5424*a* and the second end 5424*b* of the guiding base 542. Each of the retaining faces 5422 has a slot 5422*a* provided thereon, wherein an end of each of the slots 5422*a* is appropriately aligned with the first end 5424*a* of the principal axis 5424. In more details, the retaining faces 5422 extend in the first direction D1 and incline outward to gradually bias away from the principal axis 5424. In other words, a width of the guiding base 542 increases in a direction towards the second end 5424*b*. In the current embodiment, the guiding member 54 is homogeneous and solid, and therefore, a cross-sectional area of the guiding base 542 increases in the first direction D1 thereby.

The movable member 56 is approximately annular, and fits around the threaded section 524 of the pole 52, arranged between the pole 52 and the guiding base 542. The movable member 56 includes a support portion 562 and an actuation assembly 564, wherein the actuation assembly 564 includes an elastic member 5642 and an actuation portion 5644. The difference between the current embodiment and the prior embodiments is that, in the current embodiment, the number of the actuation assemblies 564 is two, and the two actuation portions 5644 are pivotally connected to two lateral sides of the support portion 562, respectively. In this way, the two actuation portions 5644 could pivot relative to the support portion 562 and rotate slightly about the support portion 562, whereby the extent of the suppression between the two actuation portions 5644 and the support portion 562 could be adjusted. Herein we take one of the actuation portions 5644 and the corresponding elastic member 5642 as an example. An end of the elastic member 5642 is connected to a free end of the actuation portion 5644, which is opposite to the support portion 562, and an opposite end of the elastic member 5642 is movably connected to one of the retaining faces 5422, which is far away from the actuation portion 5644. More specifically, an end of the elastic member 5642 hooks to the slot 5422*a* of one of the retaining faces 542, and the opposite end of the elastic member 5642 goes across the guiding base 542 to be connected to a one of the actuation portions 5644 in a secured manner. In other words, two ends of the elastic member 5642 are connected to one of the actuation portions 5644 and the guiding base 542, respectively. Therefore, the elastic member 5642 would create a force for pulling the actuation portions 5644 to approach the threaded section 524 of the pole 52. When the movable member 56 is driven by the rotation of the shaft 14 to travel in the first direction D1, the elastic member 5642 would travel along the slots 5422*a*. As the retaining faces 5422 move away from the principal axis 5424, the width of the guiding base 542 increases, the elastic member 5642 would be stretched gradually, and the force pulling the actuation portions 5644 would increase. Therefore, the suppression onto the threaded section 524 by the actuation portions 5644 would increase, and the friction between the actuation portions 5644 and the threaded section 524 would increases as well.

Figure 26:
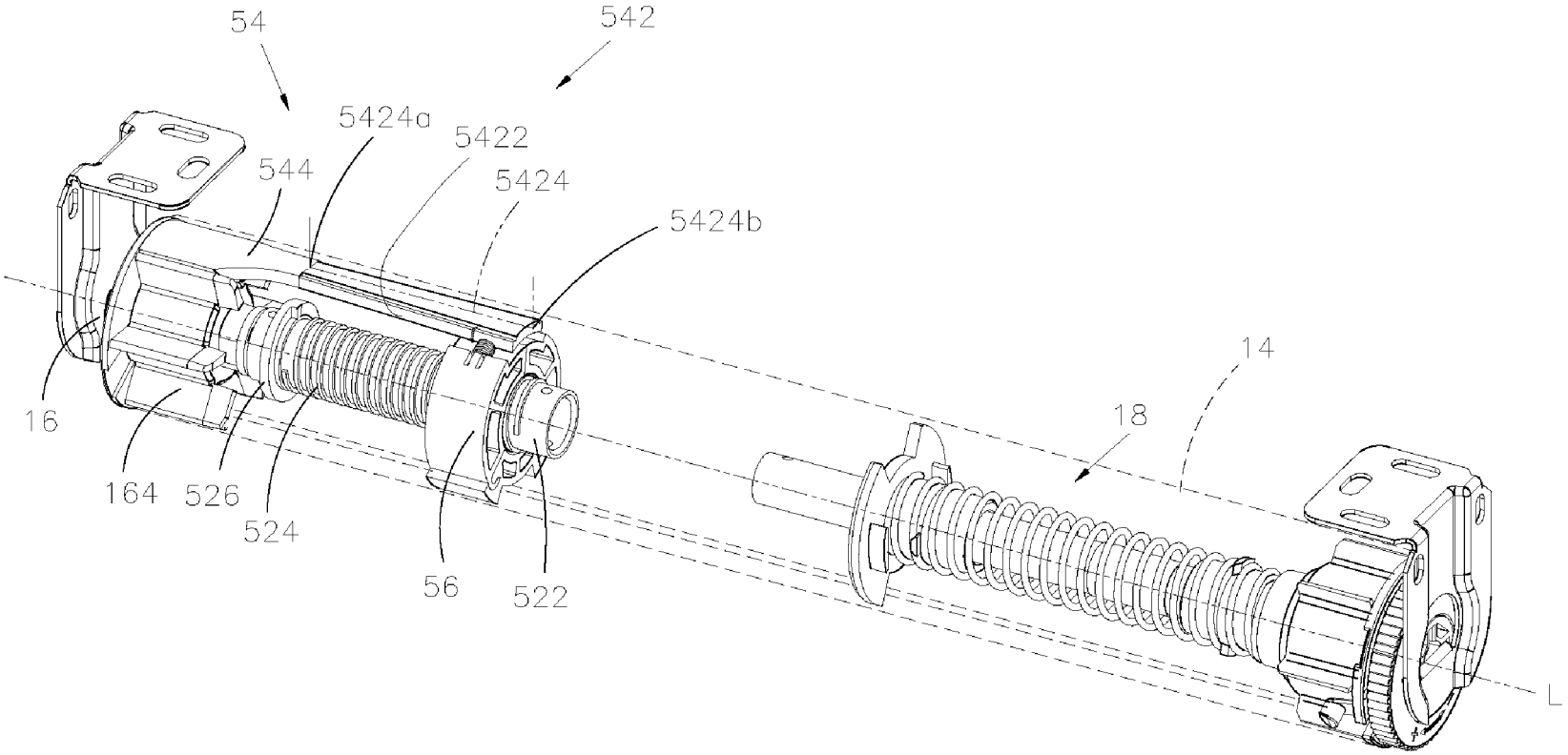
FIG. 26 is a perspective view of a position-fixing system of the fourth embodiment in accordance of the present invention, showing the arrangement of the position-fixing system in the window covering illustrated in FIG. 2.
Figure 27:
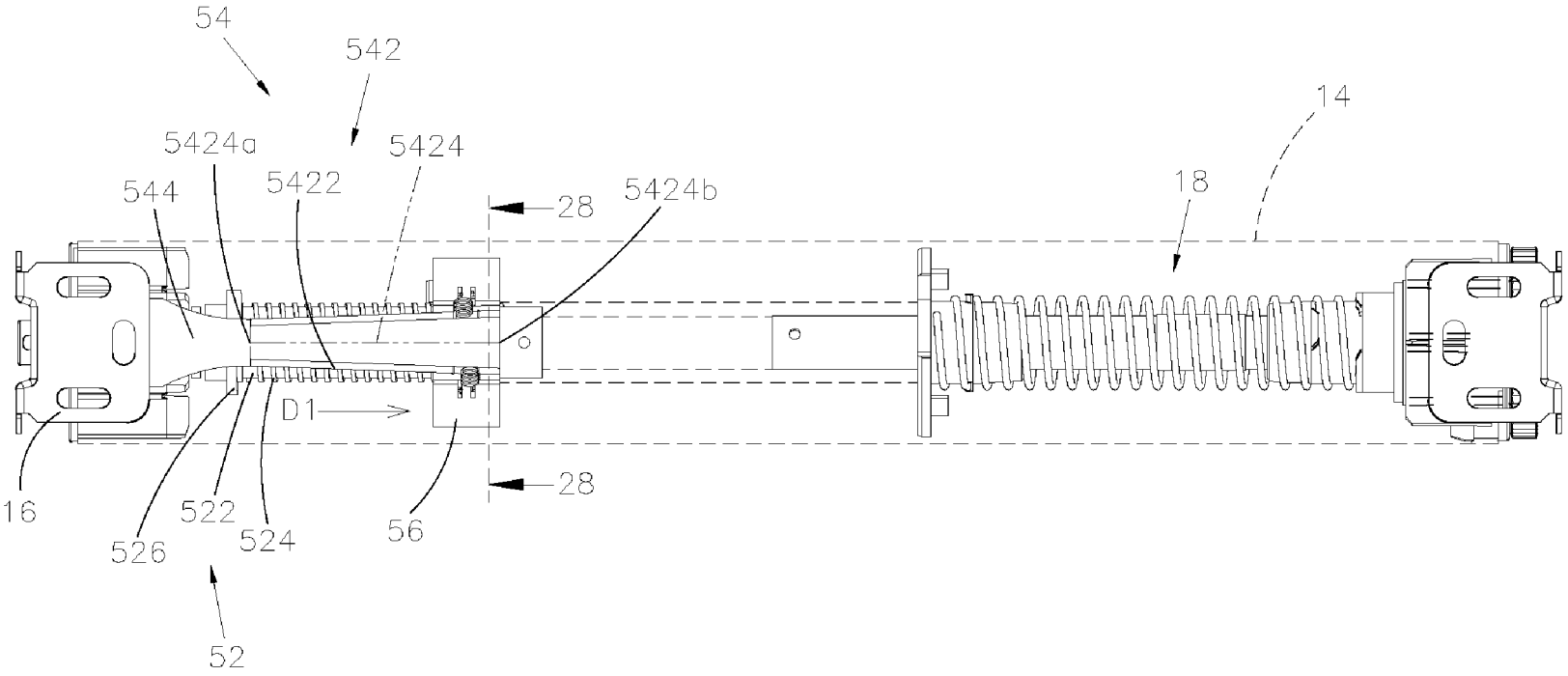
FIG. 27 is a top view of FIG. 26.
Figure 28:
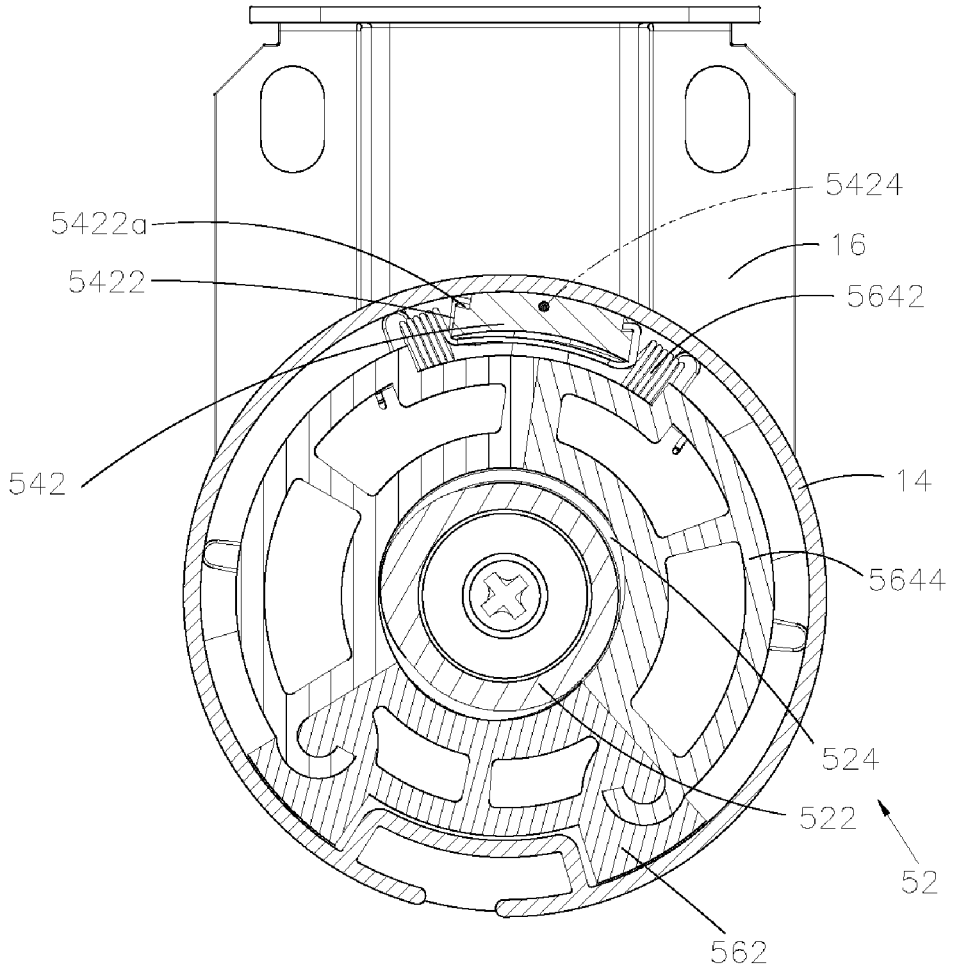
FIG. 28 is a sectional view along the 28-28 line in FIG. 27.
Figure 29:
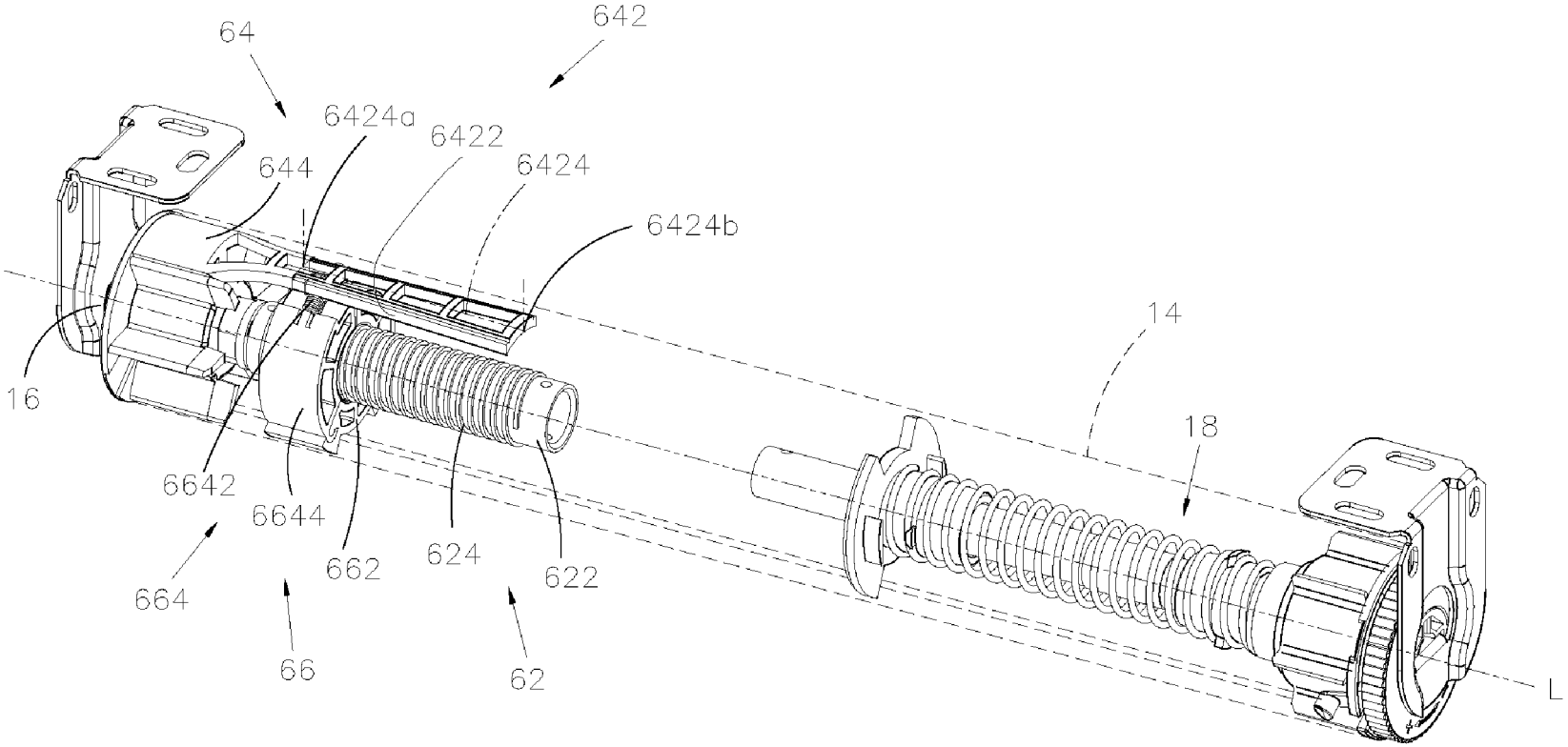
FIG. 29 is a perspective view of a position-fixing system of a fifth embodiment in accordance with the present invention, showing the arrangement of the position-fixing system in the window covering illustrated in FIG. 1.
Figure 30:
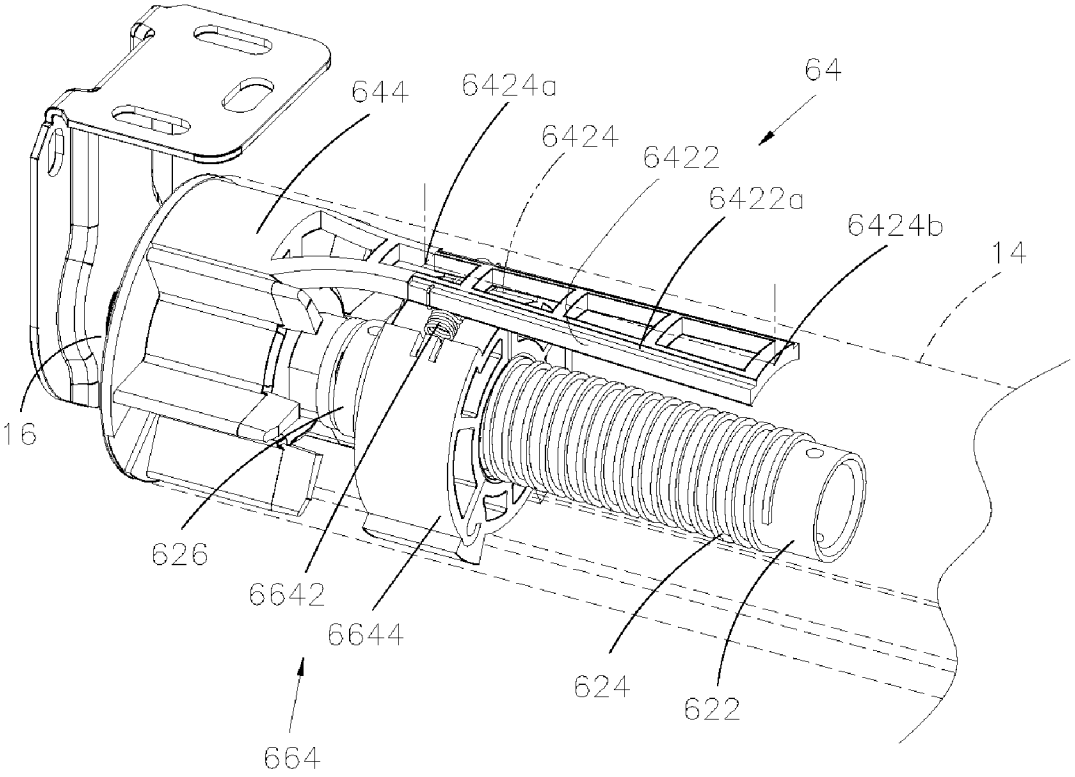
FIG. 30 is an enlarged view of FIG. 29.
Figure 31:
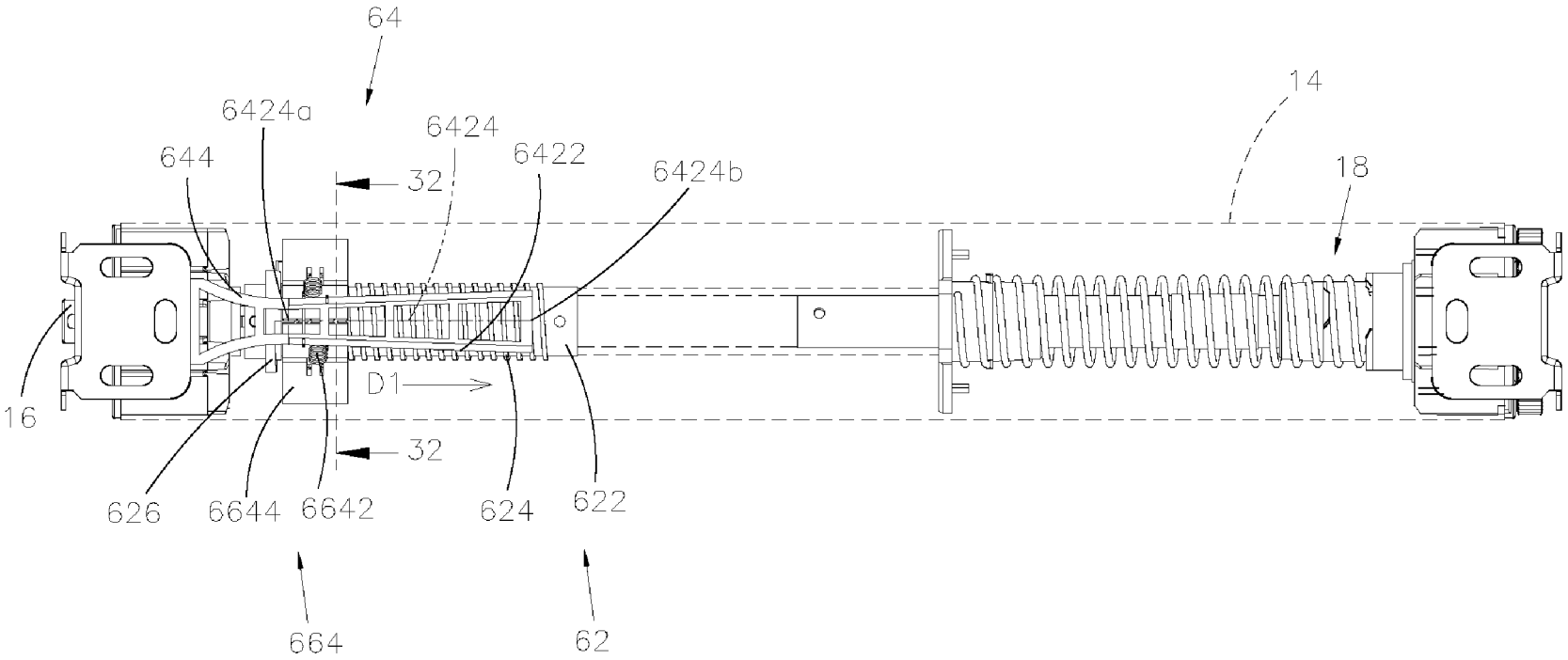
FIG. 31 is a top view of FIG. 29.
Figure 32:
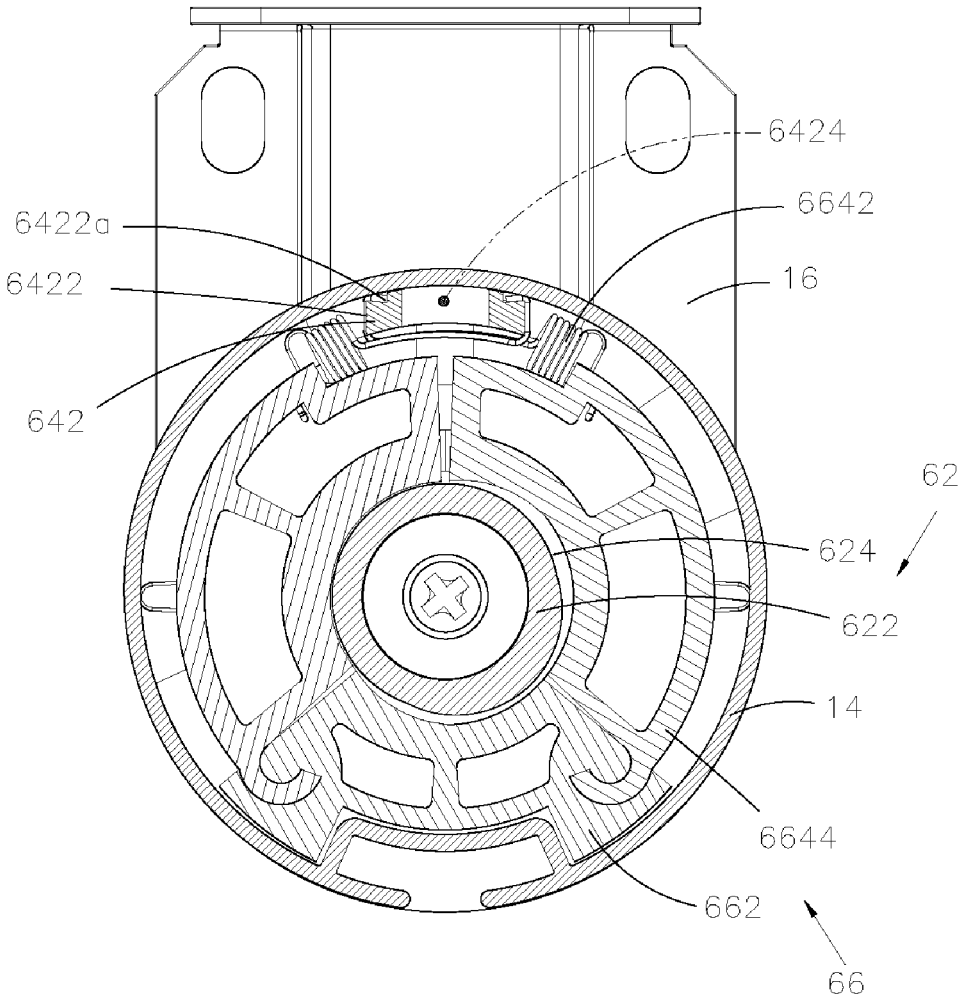
FIG. 32 is a sectional view along the 32-32 line in FIG. 31.

The operation of the position-fixing system 50 when the covering material 12 is operated to be spread out or to be retracted is further explained below. The state when the covering material 12 is retracted to the shaft 14, as depicted in FIG. 1, is defined as an initial state. The movable member 56 is adjacent to the first end 5424*a* of the principal axis 5424 of the guiding member 54, without exceeding the first stopper 526, wherein the arrangement and the state are illustrated in FIG. 22 to FIG. 25. When the covering material 12 is pulled downwards, the shaft 14 would be driven to rotate by the extension of the covering material 12, and the movable member 56 would start to rotate and to travel along the guiding member 54 in the first direction D1. In other words, the movable member 56 would travel away from the principal axis 5424 until finally reaches the second end 5424*b* of the principal axis 5424 of the guiding member 54 to fully extend the covering material 12, as depicted in FIG. 26 to FIG. 28.

As previously mentioned, during the moving of the movable member 56 in the first direction D1, the friction between the actuation portions 5644 and the threaded section 524 would increase. When the operation of pulling down the covering material 12 stops, the friction between the elastic member 5642 and the threaded section 524, the rewinding force of the power spring 184 of the power mechanism 18, and a force caused by the covering material 12 to rotate the shaft 14 would come to an equilibrium. Therefore, the covering material 12 could stay at where it is when the operation of the covering material 12 stops. When the covering material 12 is pushed upwards to be retracted, the rewinding force of the power spring 184 of the power mechanism 18 would drive the shaft 14 to retract the covering material 12, and the movable member 56 would start to rotate and to travel along the guiding base 542 in a direction opposite to the first direction D1, i.e., a direction that the retaining faces 5422 get closer to the principal axis 5424. Since the width of the guiding base 524 decreases, the elastic member 5642 across the guiding base 542 would gradually gather, and the force pulling the actuation portions 5644 would decrease. The suppression onto the threaded section 524 by the actuation portions 5644 would also decrease, and the friction between the actuation portions 5644 and the threaded section 524 would decrease as well. At the same time, the force caused by the covering material 12 to rotate the shaft 14 would decrease gradually. When the operation of pushing up the covering material 12 stops, the friction between the elastic member 5642 and the threaded section 524 of the pole 52, the rewinding force of the power spring 184 of the power mechanism 18, and the force provided by the covering material 12 to rotate the shaft 14 would come to an equilibrium. The covering material 12, again, could stay at where it is when the operation of the covering material 12 stops.

A fifth embodiment of the present invention is illustrated in FIG. 29 to FIG. 35. The configurations and the arrangements referring the components in the fifth embodiment are approximately as the same with those in the fourth embodiment. A position-fixing system 60 includes a pole 62, a guiding member 64, and a movable member 66. The position-fixing system 60 is applicable to the window covering 10 referred in the prior embodiments. The pole 62 includes a body 622, and a threaded section 624 formed around the body 622. An end of the threaded section 624 is disposed with a first stopper 626. The body 622 of the pole 62 is mounted to one of the brackets 16 of the window covering 10, and keeps firm in relative to the window covering 10. The guiding member 64 includes a guiding base 642, and a first plank 644 engaged with one of the plugs 164 of the bracket 16 to support the guiding base 542. A retaining face 6422 of the guiding base 642 corresponds to the threaded section 624 of the pole 62. The guiding base 642 is roughly shaped like a single step ladder, including two side rails and multiple parallel crossbars connecting the two side rails. The retaining face 6422 is formed on an exterior side of each side rail of the guiding base 642. A principal axis 6424 is defined as an extension line to be collinear with a central axis of the guiding base 642. The principal axis 6424 extends in the same direction with an extension axis L of the body 622, and is parallel to the extension axis L, wherein the extension axis L is collinear to a central axis of the pole 62. Two ends of the principal axis 6424 are defined as a first end 6424*a* and a second 6424*b* respectively. A first direction D1 is defined as a direction from the first end 6424*a* of the principal axis 6424 to the second end 6424*b* of the principal axis 6424. The first end 6424*a* is set at where the first plank 644 joints the guiding base 642 of the guiding member 64, and corresponds to the first stopper 626 of the pole 62.

The number of the retaining faces 6422 of the guiding base 642 is two. The retaining faces 6422 are provided on two lateral sides of the principal axis 6424, and are arranged between the first end 6424*a* and the second end 6424*b* of the guiding base 642. Each retaining face 6422 has a slot 6422*a*. The retaining faces 6422 extend in the first direction D1, and incline outwardly to gradually bias away from the principal axis 6424. In other words, a width of the guiding base 642 increases in a direction towards the second end 6424*b*, which means, the length of the crossbars of the guiding base 642 increases in the first direction D1.

The movable member 66 is approximately annular, as mentioned in prior embodiments, and fits around the threaded section 624 of the pole 62, arranged between the pole 62 and the guiding base 642 without exceeding the first stopper 626. The movable member 66 includes a support portion 662 and an actuation assembly 664, and the assembly 664 includes an elastic member 6642 and an actuation portion 6644. The actuation portion 6644 is pivotally connected to the support portion 662 to pivot relative to the support portion 662 and to rotate slightly about the support portion 662, whereby the extent of the suppression between the actuation portion 6644 and the support portion 562 could be adjusted.

An end of the elastic member 6642 is connected to the actuation portion 6644, and an opposite end of the elastic member 6642 goes across the guiding base 642 to hook to the slot 6422*a* of one of the retaining faces 6422 in a slidable manner. The two ends of the elastic member 6642 pull the actuation portion 6644 and the guiding base 642 respectively, so that the elastic member 6642 provides a force pulling the actuation portion 6644 towards the threaded section 624. When the movable member 66 travels in the first direction D1, the elastic member 6642 travels along the corresponding slot 6422*a*. As the retaining faces 6422 depart away from the principal axis 6424, the elastic member 6642 is stretched gradually, and the force pulling the actuation portion 6644 would increase. As a result, the suppression onto the threaded section 624 by the actuation portion 6644 would increase, and the friction between the actuation portion 6644 and the threaded section 624 would increase as well.

Figure 33:
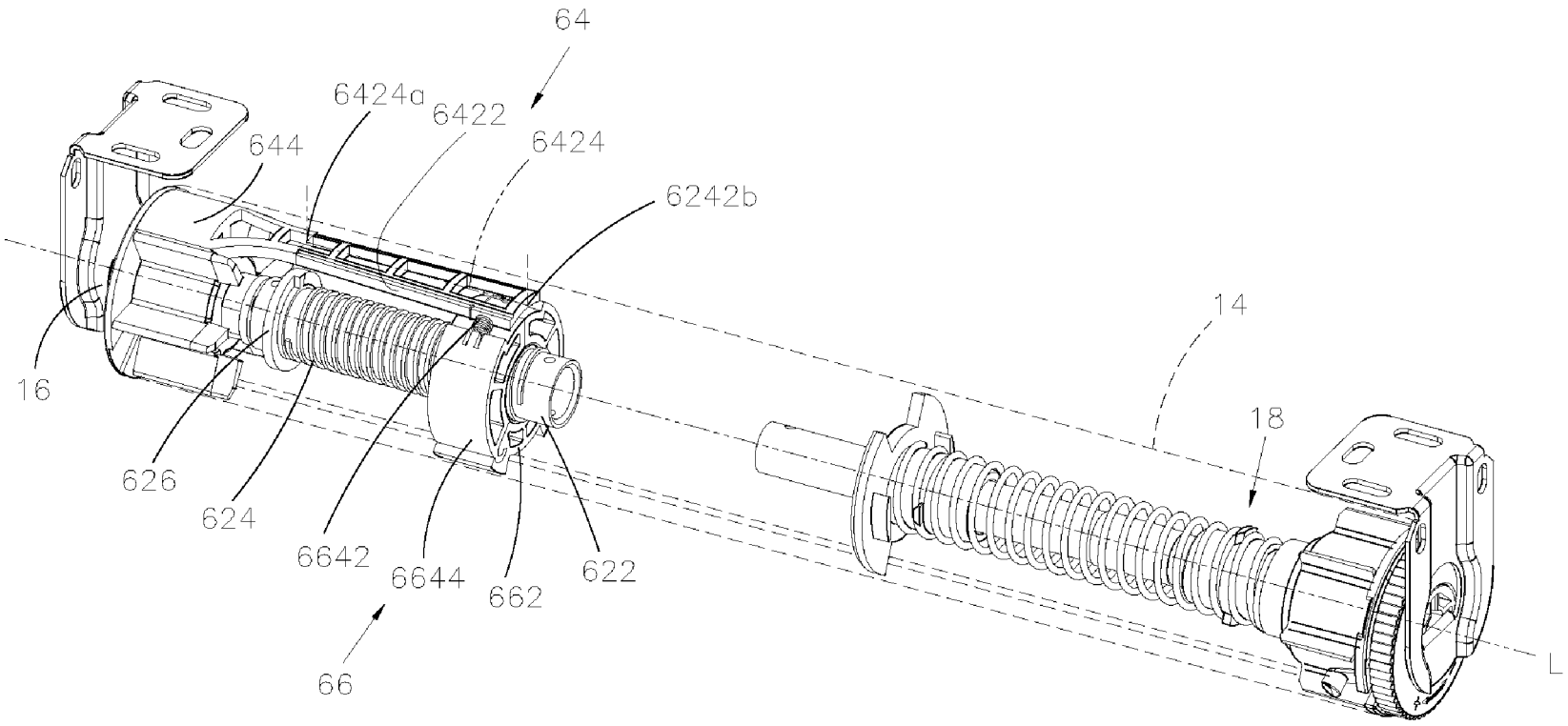
FIG. 33 is a perspective view of a position-fixing system of the fifth embodiment in accordance with the present invention, showing the arrangement of the position-fixing system in the window covering illustrated in FIG. 2.
Figure 34:
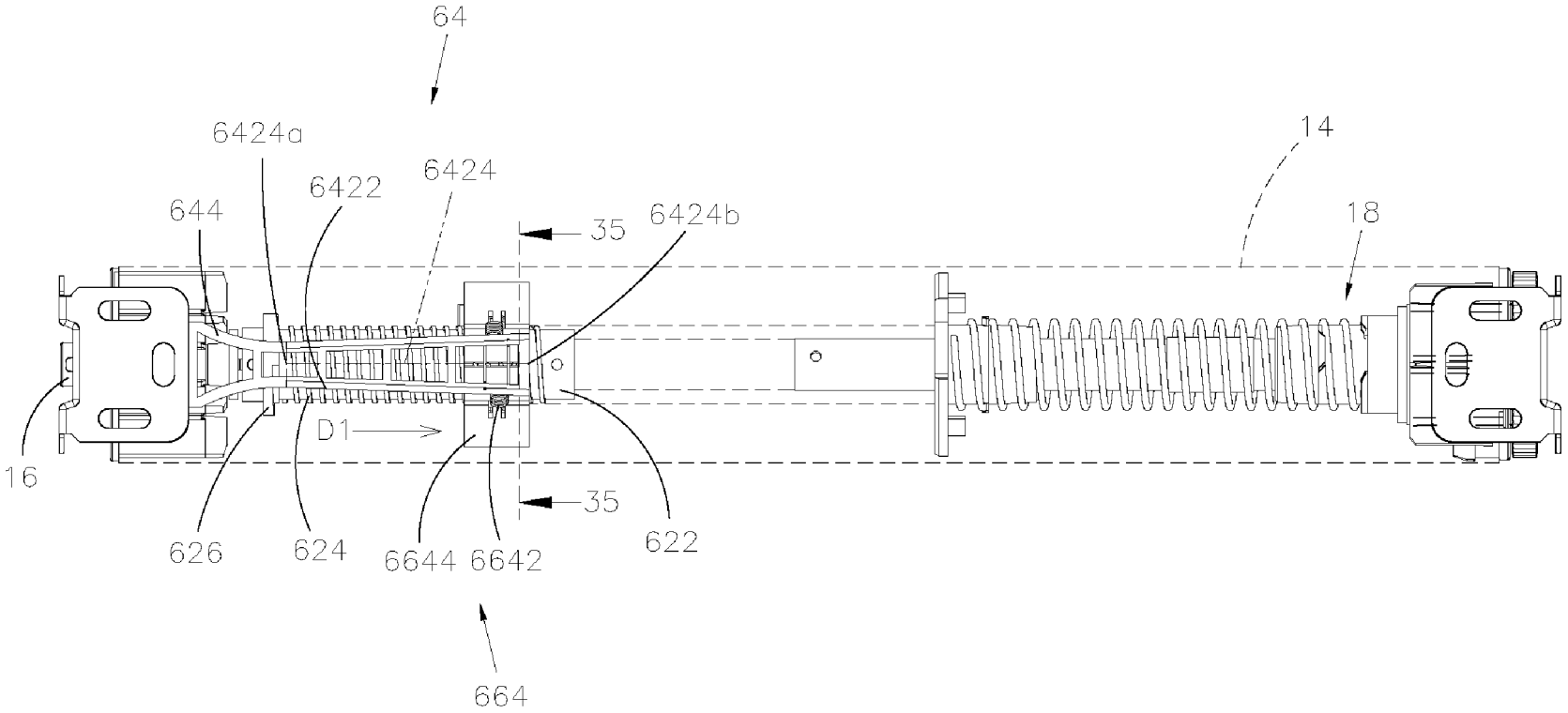
FIG. 34 is a top view of FIG. 33.
Figure 35:
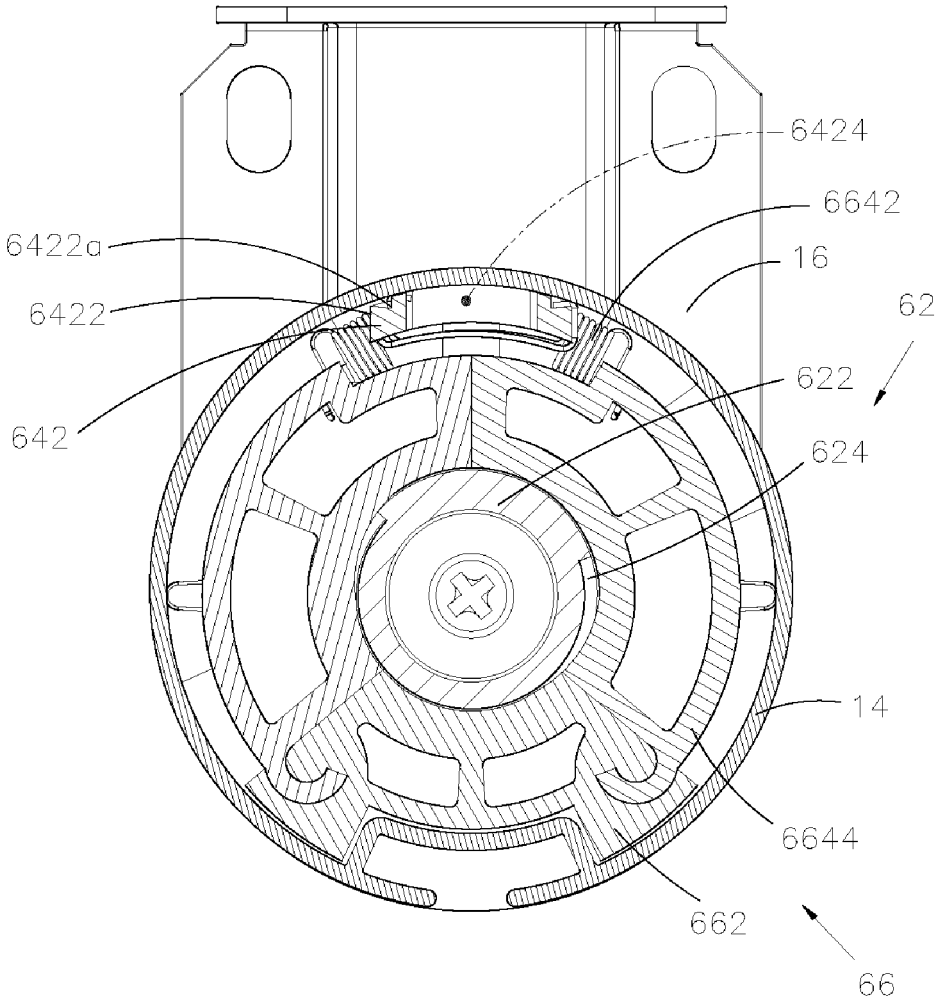
FIG. 35 is a sectional view along the 35-35 line in FIG. 34.

The state when the covering material 12 is retracted to the shaft 14, as depicted in FIG. 1, is defined as an initial state. The movable member 66 is adjacent to the first end 6424*a* of the principal axis 6424 as illustrated in FIG. 29 to FIG. 32. When the covering material 12 is pulled downwards, the shaft 14 would be driven to rotate by the extension of the covering material 12, and the movable member 66 would start to rotate and to travel in the first direction D1. In other words, the movable member 66 would move away from the principal axis 6424 until finally reaches the second end 6424*b* of the principal axis 6424, as illustrated in FIG. 33 to FIG. 35.

During the moving of the movable member 66, the friction in response to the force would increase. When the operation of pulling down the covering material 12 stops, the friction between the elastic member 6642 and the threaded section 624, the rewinding force of the power spring 184 of the power mechanism 18, and a force caused by the covering material 12 to rotate the shaft 14 would come to an equilibrium. Therefore, the covering material 12 could stay at where it is when the operation of the covering material 12 stops. Conversely, when the covering material 12 is pushed upwards to be retracted, the rewinding force of the power spring 184 of the power mechanism 18 would drive the shaft 14 to retract the covering material 12, and the movable member 66 would start to rotate and to travel along the guiding base 642 in a direction opposite to the first direction D1, i.e., a direction that the retaining faces 6422 get closer to the principal axis 6424. The width of the guiding base 642 decreases in the direction opposite to the first direction D1, and the elastic member 6642 across the guiding base 642 would gradually gather, decreasing the force pulling the actuation portions 6644. The suppression onto the threaded section 624 by the actuation portions 6644 would decrease, and the friction between the actuation portions 6644 and the threaded section 624 would also decrease. At the same time, the force that caused by the covering material 12 to rotate the shaft 14 would decrease gradually. When the operation of pushing up the covering material 12 stops, the friction between the elastic member 6642 and the threaded section 624, the rewinding force of the power spring 184 of the power mechanism 18, and the force provided by the covering material 12 to rotate the shaft 14 would come to an equilibrium to stop the covering material 12 at where it is when the operation of the covering material 12 stops.

It is worth mentioning that, the position-fixing system compatible with the window covering disclosed in the present invention allows manipulation of the covering material for extension or retraction. The position-fixing system further provides a friction between the movable member and the threaded section of the pole for stopping the covering material at the immediate position once the manipulation stops. In addition, as the width or the thickness of the guiding base gradually varies in accordance with the traveling of the movable member along an extension axis of the pole, the status the movable member in relative to the retaining face of the guiding base would change, and the friction would vary in response to the changes of the status. Therefore, the friction would be sufficient as required to counterbalance the force that the covering material provides to drive the shaft and the rewinding force, whereby the position of the covering material 12 could be precisely fixed without having any excessive upward or downward movements.

It must be pointed out that the embodiments described above are only some preferred embodiments of the present invention. All equivalent structures which employ the concepts disclosed in this specification and the appended claims should fall within the scope of the present invention. Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A position-fixing system, which is applicable to a window covering including a covering material, a shaft, and a bracket, wherein the shaft is pivotally connected to the bracket; the covering material has an end attached to the shaft, so that the covering material is adapted to be spread out from the shaft or rolled up around the shaft; the position-fixing system comprising:

a pole mounted to the bracket in an immovable manner, wherein the pole is defined to have an extension axis collinear with a central axis thereof;

a guiding member disposed in the shaft in a manner that the guiding member rotates along with the shaft, wherein the guiding member includes a guiding base spaced from the pole, and the guiding base is defined to have an imaginary line passing therethrough; the imaginary line of the guiding base and the extension axis of the pole extend in a same direction and are parallel to each other; the guiding base has a retaining face provided on a side thereof, and the retaining face and the imaginary line are non-coplanar; and a movable member fitting around the pole and arranged between the guiding base and the pole, wherein the movable member is adapted to be driven by a rotation of the shaft to rotate relative to the pole; when the covering material is operated to be spread out or rolled up, the movable member and the guiding member are driven by the rotation of the shaft to rotate about the pole, and the movable member travels forward or backward in a first direction accordingly along the pole and the guiding base; when the movable member is being moved, the movable member is guided by the retaining face to remain in contact with the pole, whereby to create a friction between the movable member and the pole;

wherein a distance between the retaining face and the imaginary line of the guiding base gradually increases in the first direction, whereby when the movable member travels in the first direction, the friction increases as the distance between the retaining face and the imaginary line of the guiding base increases.

2. The position-fixing system as claimed in claim 1, wherein the pole includes a body, a threaded section formed on the body and corresponding to the guiding base; the movable member fits around the threaded section of the pole.

3. The position-fixing system as claimed in claim 2, wherein the guiding member includes a plank connected to the guiding base; the plank is also connected to the shaft in a manner that the plank is rotatable along with the shaft, whereby when the guiding base is driven by the rotation of the shaft, the plank is also simultaneously driven to rotate about the pole.

4. The position-fixing system as claimed in claim 3, wherein the plank extends from the guiding base towards the pole; the plank has a notch, through which the body of the pole passes, so that the plank is rotatable about the body of the pole.

5. The position-fixing system as claimed in claim 4, wherein the pole includes a stopper adjacent to the threaded section; the stopper is positioned between the threaded section and the notch of the plank, and a contour of the stopper is larger than that of the notch.

6. The position-fixing system as claimed in claim 1, wherein the guiding base includes a first end and a second end respectively disposed at two ends of the imaginary line thereof; the retaining face of the of the guiding base is disposed between the first and second ends; the first direction is from the first end towards the second end; when the covering material is being spread out, the movable member travels in the first direction along the retaining face and the threaded section; when the covering material is being retracted, the movable member travels in a direction opposite to the first direction along the retaining face and the threaded section.

7. The position-fixing system as claimed in claim 6, wherein the movable member includes a support portion and an actuation assembly; a distance between the pole and the support portion is constant in a radial direction of the pole; the actuation assembly is movably provided relative to the support member, and is adapted to travel along the threaded section along with the support portion; when the movable member travels in the first direction, as the distance between the retaining face and the imaginary line of the guiding base increases, the actuation assembly gradually presses harder on the threaded section in the radial direction of the pole, gradually increasing the friction.

8. The position-fixing system as claimed in claim 7, wherein the retaining face of the guiding base is arranged to face the threaded section and is set between the imaginary line and the threaded section; the distance between the retaining face and the pole decreases as the distance between the retaining face and the imaginary line of the guiding base increases.

9. The position-fixing system as claimed in claim 7, wherein the retaining face of the guiding base is provided on a side of the imaginary line; the retaining face of the guiding base, the imaginary line of the guiding base, and the extension axis of the pole are non-coplanar.

10. The position-fixing system as claimed in claim 7, wherein the actuation assembly includes an elastic member provided corresponding to the threaded section, and the elastic member is adapted to create a force; when the movable member is driven to travel in the first direction by the rotation of the shaft, the force increases as the distance between the retaining face and the imaginary line of the guiding base increases, and the friction increases as the force increases.

11. The position-fixing system as claimed in claim 10, wherein the support portion is provided with a passage in the radial direction of the pole; the passage communicates the retaining face and the threaded section, and the actuation assembly is received in the passage of the support portion in a movable manner; when the movable member travels in the first direction, as the distance between the retaining face and the imaginary line of the guiding base increases, the retaining face pushes harder against the actuation assembly, so that the force created by the elastic member increases, and the friction between the actuation assembly and the threaded section therefore increases; when the movable member travels in the direction opposite to the first direction, as the distance between the retaining face and the imaginary line of the guiding base decreases, the retaining face pushes lighter against the actuation assembly, so that the force created by the elastic member decreases, and the friction between the actuation assembly and the threaded section therefore decreases.

12. The position-fixing system as claimed in claim 11, wherein the actuation assembly includes an actuation portion, which is disposed between the elastic member and the retaining face; the actuation portion has an end abutting against the retaining face, and an opposite end abutting against the elastic member; the elastic member has an end opposite to the actuation portion, abutting against the threaded section; when the movable member travels in the first direction, the actuation portion moves towards the threaded section in the radial direction of the pole, for the distance between the retaining face and the imaginary line of the guiding base increases, whereby the force created by the elastic member increases, and the friction between the actuation assembly and the threaded section therefore increases; when the movable member travels in the direction opposite to the first direction, as the distance between the retaining face and the imaginary line of the guiding base decreases, the actuation portion is pushed away from the threaded section in the radial direction of the pole by the elastic member, whereby the force created by the elastic member decreases, and the friction between the actuation assembly and the threaded section therefore decreases.

13. The position-fixing system as claimed in claim 10, wherein the actuation assembly includes an actuation portion; the actuation portion has an end pivotally connected to the support portion to be pivotally swung relative to the support portion, and an opposite end connected to an end of the elastic member; another end of the elastic member opposite to the actuation portion is connected to the retaining face of the guiding member in a movable manner, the retaining face is between the two ends of the elastic member, and the actuation portion is adapted to be pulled by the force to approach the threaded section; when the movable member travels in the first direction, as the distance between the retaining face and the imaginary line of the guiding base increases, the elastic member is getting stretched, and the force exerted onto the actuation portion increases, whereby the actuation portion gradually swings toward the threaded section in the radial direction of the pole with the support portion as a pivotal center to tightly abut against the threaded portion, so that the friction between the actuation portion and the threaded section increases; when the movable member travels in the direction opposite to the first direction, as the distance between the retaining face and the imaginary line of the guiding base decreases, the elastic member is compressed, so that the force exerted onto the actuation portion decreases, and the friction between the actuation portion and the threaded section therefore decreases.

14. The position-fixing system as claimed in claim 13, wherein the retaining face has a slot provided thereon; the another end of the elastic member movably hooks to the slot of the retaining face; when the movable member moves, the another end of the elastic member moves along the slot in accordance with a movement of the actuation portion.

15. A position-fixing system, which is applicable to a window covering including a covering material, a shaft, and a bracket, wherein the shaft is pivotally connected to the bracket; the covering material has an end attached to the shaft so that the covering material is adapted to be spread out from the shaft or rolled up around the shaft; the position-fixing system comprising:

a pole mounted to the bracket in an immovable manner, wherein the pole is defined to have an extension axis collinear with a central axis thereof;

a guiding member adjacent to the pole, wherein the guiding member is adapted to be driven by a rotation of the shaft; and a movable member fitting around the pole and arranged between the guiding member and the pole, wherein the movable member is adapted to be driven by the rotation of the shaft; when the covering material is operated to be spread out or rolled up, the movable member and the guiding member are driven by the rotation of the shaft and rotate about the pole, the movable member travels along the pole and the guiding member forward or backward in a first direction accordingly; a friction is created between the movable member and the pole when the movable member is being moved, for the movable member is guided by the guiding member to keep in contact with the pole;

wherein the guiding member has a cross-section, which is defined to be orthogonal to the extension axis of the pole; a cross-sectional area of the cross-section of the guiding member increases in the first direction, and the first direction is parallel to the extension axis of the pole; the friction increases as the cross-sectional area increases.

16. The position-fixing system as claimed in claim 15, wherein the movable member travels in the first direction while the covering material is being spread out; the movable member travels in a direction opposite to the first direction while the covering material is being retrieved.

17. The position-fixing system as claimed in claim 15, wherein the movable member includes a support portion and an actuation portion; a distance between the pole and the support portion in a radial direction of the pole is constant; the actuation assembly is movable relative to the support member, and is adapted to be moved with the support portion along the pole; when the movable member travels, as the cross-sectional area increases, the actuation portion approaches the pole, increasing the friction.

18. The position-fixing system as claimed in claim 17, wherein the movable member includes an elastic member corresponding to the actuation portion, and the elastic member is adapted to exert a force on the actuation portion; when the movable member is driven by the rotation of the shaft to travel in the first direction, as the cross-sectional area increases, the force increases, and the friction therefore increases.

19. The position-fixing system as claimed in claim 18, wherein the support portion has a passage in the radial direction of the pole; an end of the passage faces the guiding member; the elastic member and the actuation portion are movably received in the passage; the actuation portion is disposed between the elastic member and the guiding member; the actuation portion has an end abutting against the guiding member and an opposite end abutting against the elastic member; the elastic member has an end opposite to the actuation portion abutting against the pole; when the movable member travels, as the cross-sectional area increases, the actuation portion approaches the pole, increasing the friction between the elastic member and the pole; when the movable member travels in an opposite direction, as the cross-sectional area decreases, the force of the elastic member pushes the actuation portion to move away from the pole, decreasing the friction between the elastic member and the pole.

20. The position-fixing system as claimed in claim 19, wherein a thickness of the guiding member measured in the radial direction of the pole increases in the first direction, and the cross-sectional area increases in the first direction thereby.

21. The position-fixing system as claimed in claim 18, the actuation portion has an end pivotally connected to the support portion to be pivotally swung relative to the support portion, and an opposite end connected to the elastic member; the elastic member has an end opposite to the actuation portion movably connected to the guiding member; the guiding member is between the two ends of the elastic member, and the actuation portion approaches the pole when applied with the force; when the movable member travels in the first direction, as the cross-sectional area increases, the elastic member is getting stretched, and the force applied to the actuation portion increases thereby, so that the actuation portion swings toward the pole with the support portion as a pivotal center to tightly press the pole, increasing the friction between the actuation portion and the pole; when the movable member travels in an opposite direction, as the cross-sectional area decreases, the elastic member is getting compressed, and the force applied to the actuation portion decreases thereby, decreasing the friction between the actuation portion and the pole.

22. The position-fixing system as claimed in claim 21, wherein the guiding member has a slot provided on a side thereof opposite to the actuation portion, the end of the elastic member movably hooks to the slot of the guiding member; when the movable member moves, the end of the elastic member moves along the slot in accordance with a movement of the actuation portion.

23. The position-fixing system as claimed in claim 22, wherein a width of the guiding member increases in the first direction, and the cross-sectional area increases in the first direction thereby.

24. The position-fixing system as claimed in claim 17, wherein the pole and the support portion has corresponding male threads and female threads respectively, whereby the movable member is rotatable relative to the pole and is movable forward or backward in the first direction accordingly along the pole.

* * * * *